US009899016B2

(12) United States Patent
Okazaki et al.

(10) Patent No.: US 9,899,016 B2
(45) Date of Patent: Feb. 20, 2018

(54) MUSICAL SOUND SIGNAL GENERATION APPARATUS THAT GENERATES SOUND EMULATING SOUND EMITTING FROM A ROTARY SPEAKER

(71) Applicant: YAMAHA CORPORATION, Hamamatsu-shi, Shizuoka-ken (JP)

(72) Inventors: Masatsugu Okazaki, Hamamatsu (JP); Taro Shirahama, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/247,270

(22) Filed: Aug. 25, 2016

(65) Prior Publication Data

US 2017/0061945 A1 Mar. 2, 2017

(30) Foreign Application Priority Data

Aug. 31, 2015 (JP) ..... 2015-171065

(51) Int. Cl.
*G10H 1/06* (2006.01)
*G10H 7/04* (2006.01)
*G10H 1/047* (2006.01)

(52) U.S. Cl.
CPC ..... *G10H 7/04* (2013.01); *G10H 1/047* (2013.01)

(58) Field of Classification Search
USPC ..... 84/604
See application file for complete search history.

(56) References Cited

U.S. PATENT DOCUMENTS 3,699,234 A * 10/1972 Adachi ..... G10H 5/005 84/678
3,842,204 A * 10/1974 Leslie ..... G10H 1/043 381/62
3,864,517 A * 2/1975 Wilder ..... H02P 27/04 381/62
4,308,428 A * 12/1981 Finch ..... G10H 1/043 381/62
5,623,112 A * 4/1997 Ito ..... G10H 1/0033 84/610
5,848,166 A * 12/1998 Fisher ..... G10H 1/0091 381/62
6,967,599 B2 * 11/2005 Choi ..... G10L 21/04 341/61
2001/0029830 A1 * 10/2001 Rosen ..... G09B 15/04 84/478

FOREIGN PATENT DOCUMENTS

JP H07-181970 A 7/1995
JP 2003058159 A 2/2003

* cited by examiner

*Primary Examiner* — Christopher Uhlir
(74) *Attorney, Agent, or Firm* — Rossi, Kimms & McDowell LLP

(57) ABSTRACT

An electronic musical instrument includes a storage unit storing waveform data WD constituted by a plurality of sample values, the waveform data expressing an acoustic waveform of a musical sound emitted from a speaker while a rotor rotates about a rotation axis by a predetermined angle, and a reproduction unit configured to sequentially read out the sample values from the storage unit and generate a musical sound signal based on the read-out sample values, the reproduction unit being configured to change a reproduction speed of the musical sound expressed by the plurality of sample values, without changing a pitch and formant of the musical sound.

17 Claims, 14 Drawing Sheets

MUSICAL SOUND SIGNAL GENERATION APPARATUS THAT GENERATES SOUND EMULATING SOUND EMITTING FROM A ROTARY SPEAKER

CROSS REFERENCE

This application claims priorities to Japanese Patent Applications No. 2015-171065 filed on Aug. 31, 2015, which is hereby incorporated by reference in its entirety.

TECHNICAL FIELD

The present invention relates to a musical sound signal generation apparatus that generates a musical sound signal by sequentially reading out sample values constituting waveform data that expresses a waveform of a musical sound, from a waveform memory in which the waveform data is stored. In particular, the present invention relates to a musical sound signal generation apparatus that generates a musical sound signal imitating the sound of an electric organ emitted from a conventional rotary speaker.

BACKGROUND ART

Conventionally, there are known to be electric organs that include multiple tone wheels. A tone wheel is a gear-shaped member. That is, a tone wheel is such that multiple recesses and protrusions are formed on the circumferential surface of a disc-shaped member. The number of recesses and protrusions corresponds to the pitch. An electric organ includes electromagnetic pickups that are arranged so as to oppose the respective circumferential surfaces of the tone wheels. When the multiple tone wheels are rotated by a motor, the magnetic fields around the electromagnetic pickups change periodically due to the rotation. Electric signals corresponding to the changes in the magnetic fields are output from the electromagnetic pickups. The electric signals are amplified by amplifiers and are output from output terminals.

In the electric organ, basically, nine drawbars (slide switches including multiple contact points) are mounted, and a fundamental tone (8'), a second harmonic (4'), a third harmonic (2−⅔'), a fourth harmonic (2'), a fifth harmonic (1+⅔'), a sixth harmonic (1+⅓'), an eighth harmonic (1'), a tone that is an octave lower than the fundamental tone (16'), and a third harmonic of 16' (5+⅓') are respectively allocated to the drawbars. Note that "'" means "feet" (unit expressing the length of a pipe of a pipe organ). When one key of the electric organ is pressed, the fundamental tone corresponding to that key and the other eight harmonics thereof are simultaneously output. The above-described drawbars are operators for adjusting the volumes of the fundamental tone and the harmonics. In other words, the drawbars are operators for setting the timbre.

Also, conventionally, a rotary speaker is known as a speaker that is used when reproducing an output signal of an electric organ. A rotary speaker includes a speaker unit that is fixed in an upward or downward orientation, and a rotor (horn) that rotates about a rotational axis extending in the vertical direction above or below the speaker unit and causes the sound emission direction to rotate. Thus, by rotating the sound emission direction, auditory effects (chorus, tremolo, etc.) are applied to the reproduced sound. A rotary speaker is configured such that the rotation speed of the rotor can be selected. For example, upon setting a rotation speed selection switch to "FAST", the rotor rotates at about 400 rpm. On the other hand, upon setting the rotation speed selection switch to "SLOW", the rotor rotates at about 50 rpm. Also, when the rotation speed is switched from "FAST" to "SLOW" or from "SLOW" to "FAST", the rotation speed of the rotor gradually changes.

Conventionally, various electronic musical instruments capable of imitating the effect obtained using such a rotary speaker have been proposed. For example, the electronic musical instrument proposed in Patent Document 1 (Japanese Patent Application Laid-Open Publication No. 2003-058159) stores waveform data expressing the waveform of an output signal of an electric organ. The waveform data expresses a sound in state prior to the effect of the rotary speaker being applied thereto. The electronic musical instrument sequentially reads out sample values constituting the waveform data to reproduce a signal similar to the output signal of the electric organ. Here, the electronic musical instrument includes a modulation circuit that modulates the reproduced signal. Using the modulation circuit, this electronic musical instrument can reproduce a signal to which an effect similar to the effect obtained using the rotary speaker is applied.

Also, for example, the electronic musical instrument proposed in Patent Document 2 (Japanese Patent Application Laid-Open Publication No. H07-181970) stores impulse responses at rotation angles of a rotor of a rotary speaker. The impulse responses are measured as follows. First, an impulse signal is input to an input terminal of the rotary speaker in a state in which the rotor faces forward. The reproduced sound is sampled using a microphone placed in front of the cabinet of the rotary speaker. Next, an impulse signal is input to the input terminal of the rotary speaker in a state in which the rotor has been rotated by a predetermined minute angle. The reproduced sound is sampled using the microphone. Thereafter, the task of measuring and recording the impulse response each time the rotor is rotated by the predetermined minute angle is repeated until the rotor has performed one rotation about the rotation axis. Also, similarly to the electronic musical instrument disclosed in Patent Document 1 described above, this electronic musical instrument sequentially reads out sample values constituting waveform data to reproduce a signal that is similar to the output signal of the electric organ. This electronic musical instrument selects one impulse response among the multiple impulse responses according to the rotation angle of the rotor. Then, the electronic musical instrument outputs a signal obtained by convoluting the reproduced signal and the currently-selected impulse response. Accordingly, it is possible to output a signal to which an effect similar to the effect obtained using the rotary speaker has been applied.

However, with the electronic musical instrument disclosed in Patent Document 1 described above, the modulated signal of the modulation circuit is relatively simple, and therefore it is difficult to reliably imitate the effect obtained using the rotary speaker.

Also, with the electronic musical instrument according to Patent Document 2 described above, the load of the convolution calculation is high, and therefore a calculation device with a high processing ability is used, which causes the component cost to increase.

Solution to Problem

A musical sound signal generation apparatus according to an aspect of the present invention is a musical sound signal generation apparatus for generating a musical sound signal expressing a musical sound of an electric organ emitted from a speaker that includes a rotor that rotates about a predetermined rotational axis and causes a sound emission direction to rotate, including: a storage unit storing a piece of waveform data constituted by a plurality of sample values, the piece of waveform data expressing an acoustic waveform of a musical sound emitted from the speaker while the rotor rotates about the rotation axis by a predetermined angle; and a reproduction unit configured to sequentially read out the sample values from the storage unit and generate a musical sound signal based on the read-out sample values, the reproduction unit being configured to be able to change a reproduction speed of the musical sound expressed by the plurality of sample values, without changing a pitch and formant of the musical sound.

The musical sound signal generation apparatus according to the above-described configuration stores waveform data expressing a musical sound produced by a rotary speaker while a rotor rotates by a predetermined angle (e.g., while rotating approximately once about a rotation axis). Also, when the waveform data is repeatedly read out to reproduce a musical sound signal, the musical sound generation apparatus changes the reproduction speed of the musical sound signal without changing the pitch and formant, thereby imitating the musical sound emitted from a rotor rotating at a predetermined rotation speed. Accordingly, with the above-described configuration, waveform data expressing a musical sound emitted from a rotary speaker while a rotor rotates by a predetermined angle is used, and therefore the effect of the rotary speaker can be reliably imitated. Also, because the effect of the rotary speaker is imitated by changing the reproduction speed, there is no need to perform a complicated calculation such as a convolution calculation. For this reason, with the above-described configuration, there is no need to use a calculation device with a high calculation ability, and therefore the component cost can be suppressed.

Also, as another aspect of the musical sound signal generation apparatus according to the above-described aspect, the musical sound signal generation apparatus may further include an operator for setting the reproduction speed of the musical sound, and the reproduction unit may be configured to determine the reproduction speed of the musical sound according to an operation state of the operator.

Also, as another aspect of the musical sound signal generation apparatus according to the above-described aspect, the reproduction unit may be configured to change the reproduction speed of the musical sound using a pitch synchronous overlap and add method.

Also, as another aspect of the musical sound signal generation apparatus according to the above-described aspect, the storage unit may include a plurality of the pieces of waveform data, and the reproduction unit may be configured to read out sample values corresponding to each other from among sample values constituting the plurality of pieces of waveform data.

The phase of each musical sound signal corresponds to the rotation angle of the rotor of the rotary speaker. In the above-described configuration, when simultaneously reading out multiple pieces of waveform data in order to simultaneously generate multiple musical sound signals, the reproduction unit reads out sample values stored at addresses that correspond to each other. That is, the reproduction unit reproduces the musical sounds with the phases of the musical sounds approximately synchronous. For this reason, when multiple musical sound signals are generated, the musical sound signals express musical sounds emitted from rotors facing almost the same direction. Accordingly, with the above-described configuration, the state in which multiple musical sounds are emitted from one rotor can be imitated reliably.

Also, as another aspect of the musical sound signal generation apparatus according to the above-described aspect, it is possible to use an information processing system, an information processing method, a program, or a recording medium readable by a computer, another apparatus, machine, or the like storing such a program, for realizing the above-described configurations. Here, a recording medium readable by a computer or the like is a medium that accumulates information such as a program by electric, magnetic, optical, mechanical, or chemical means. Also, the information processing system may be realized by one or more information processing apparatuses.

DESCRIPTION OF EMBODIMENTS

Hereinafter, an embodiment of an aspect of the present invention (hereinafter referred to as "the present embodiment" as well) will be described with reference to the drawings. However, the embodiments described hereinafter are merely examples of the present invention in all respects. Various improvements and modifications can be performed without departing from the scope of the present invention. That is, in the implementation of the present invention, specific configurations corresponding to the embodiment may be used as appropriate.

First Embodiment

Figure 1:
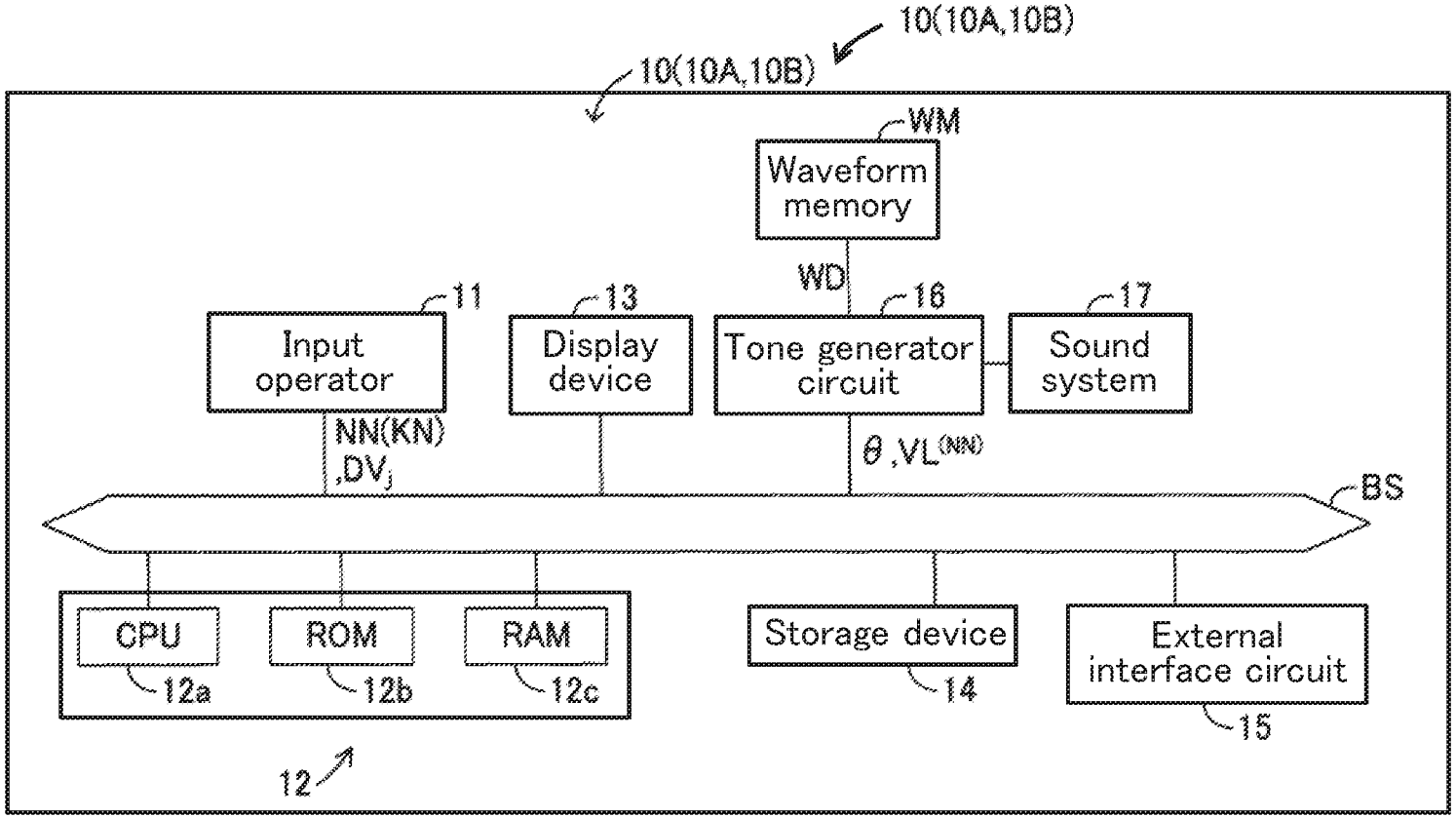
FIG. 1 is a block diagram showing a hardware configuration of an electronic musical instrument according to first to third embodiments of the present invention.

First, an overview of an electronic musical instrument 10, which is a musical sound signal generation apparatus according to an embodiment of the present invention and is illustrated in FIG. 1, will be described. This electronic musical instrument 10 reads out waveform data WD expressing a waveform of a sound from a waveform memory WM and reproduces the sound expressed by the read-out waveform data WD. In the present embodiment, for the sake of convenience in the description, the electronic musical instrument 10 imitates an electric organ including 91 tone wheels. Note that the type of the electric organ to be imitated by the electronic musical instrument 10 need not be limited to this example, and may be selected as appropriate according to the embodiment. Note that note numbers NN are associated in order starting from the tone wheel of the lowest tone to the tone wheel of the highest tone. The note number NN of the tone wheel of the lowest tone is "1", and the note number NN of the tone wheel of the highest tone is "91".

The waveform data WD is generated based on sampling data, which is obtained by sampling a sound that is emitted when a signal output from an electric organ is input to a rotary speaker in a state in which a single tone wheel of the electric organ is selected (e.g., a state in which only the "8'" drawbar among the drawbars is pulled out and one key is pressed). The waveform data WD expresses the waveform of a musical sound emitted while the rotor of the rotary speaker performs one rotation about its rotational axis. Hereinafter, the waveform data WD corresponding to the note number NN will be denoted as "waveform data $WD^{(NN)}$". The electronic musical instrument 10 repeatedly reads out the waveform data $WD^{(NN)}$ to continuously reproduce the musical sound signal corresponding to the note number NN. When multiple musical sound signals of different pitches are reproduced, the phases of the multiple reproduced musical sound signals are approximately synchronous. The phase of a musical sound signal corresponds to the orientation of the opening portion of the rotor (rotational angle about the rotational axis of the rotor).

Also, the electronic musical instrument 10 has a time stretching function. The time stretching function is a function of changing the length of a sound while maintaining the pitch and formant of the sound. In other words, with the time stretching function, it is possible to extend and shorten a sound in a time axis direction, or in other words, it is possible to change only the reproduction speed (speed with which time advances) of the musical sound signal. The electronic musical instrument 10 uses the time stretching function to extend and shorten each piece of waveform data in the time axis direction by the same extension and shortening rates. That is, the electronic musical instrument 10 changes the reproduction speed of the musical sound signal. Accordingly, the electronic musical instrument 10 imitates a reproduced sound (the above-described sound emitted from the rotary speaker) at a time when the rotation speed of the rotor of the rotary speaker is set to "SLOW" in the electric organ, a reproduced sound at a time when the rotation speed of the rotor is set to "FAST", and a reproduced sound at a time when the rotation speed of the rotor gradually changes. Note that in the present embodiment, a known pitch synchronous overlap and add method is used to achieve the time stretching function.

Configuration Example

Next, a configuration example of the electronic musical instrument 10 will be described. As illustrated in FIG. 1, the electronic musical instrument 10 includes an input operator 11, a control unit 12, a display device 13, a storage device 14, an external interface circuit 15, and a tone generator circuit 16, which are connected to each other via a bus BS. The waveform memory WM and a sound system 17 are connected to the tone generator circuit 16. The waveform memory WM corresponds to a "storage unit" of the present invention, and the tone generator circuit 16 corresponds to a "reproduction unit" of the present invention.

Figure 2:
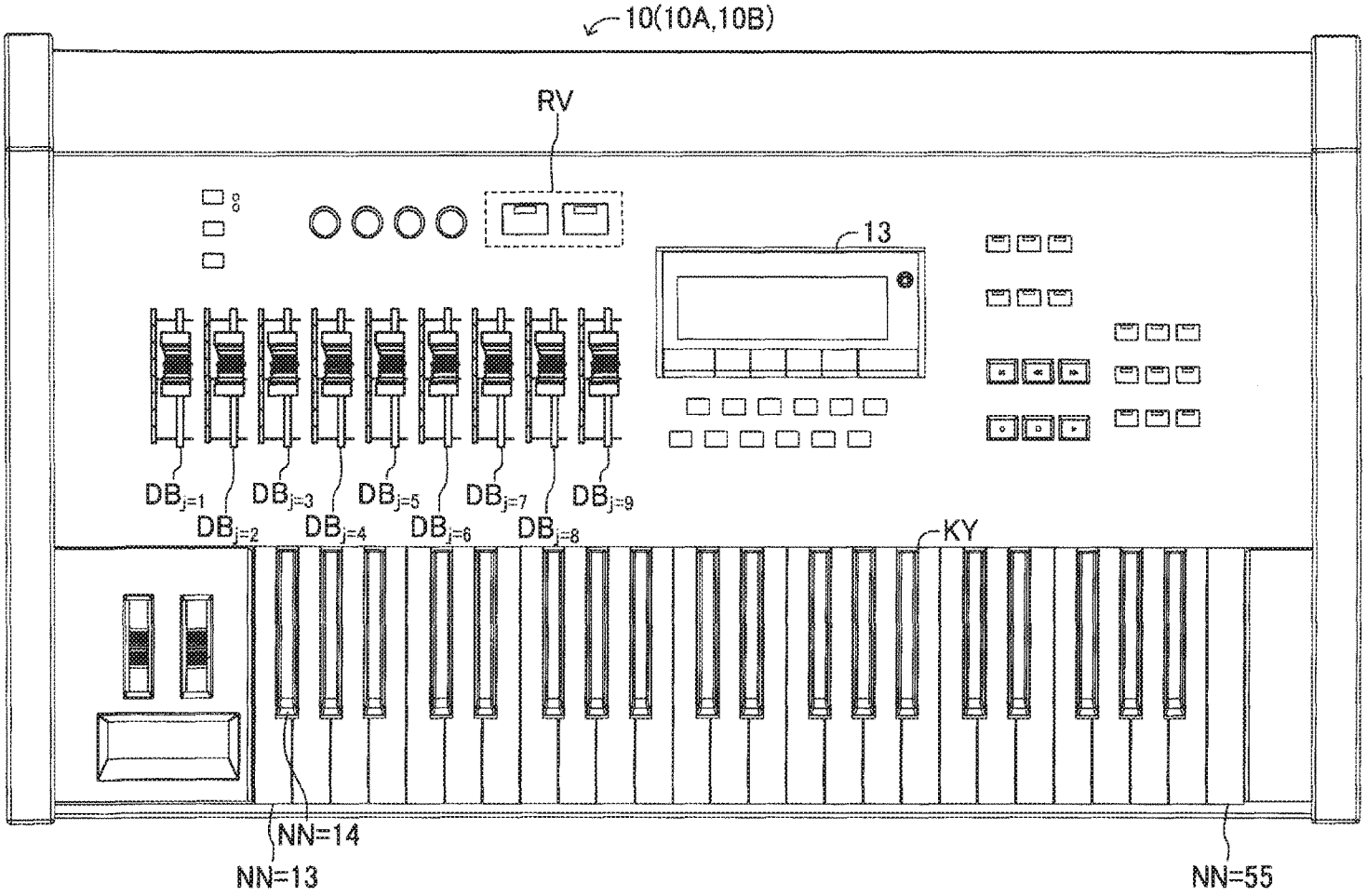
FIG. 2 is a plan view showing an exterior of the electronic musical instrument shown in FIG. 1.

The input operators 11 include musical performance operators and setting operators. As shown in FIG. 2, the musical performance operators and setting operators are composed of switches corresponding to on/off operations (e.g., a numeric pad for inputting numeric values), volume knobs, rotary encoders, or switches corresponding to a rotation operation, volume sliders, linear encoders, or switches corresponding to a sliding operation, a mouse, a touch panel, and the like. The musical performance operators are used for starting and stopping sound generation, and the like. Also, the setting operators are used for setting the volume, setting the timbre, and the like. The operation information indicating the operation content of the input operators 11 (instruction values of the operators) is supplied to the later-described control unit 12 via the bus BS.

For example, as illustrated in FIG. 2, a keyboard device KY is included in the musical performance operators. The keyboard device KY includes multiple keys. Note numbers NN are assigned in order from the key with the lowest tone to the key with the highest tone. The note number NN of the key with the lowest tone is "13", and the note number NN of the key with the highest tone is "55".

Also, for example, as illustrated in FIG. 2, drawbars $DB_{j=1,2,\ldots,9}$ are included in the setting operators. The drawbar $DB_{j=1}$ is the operator for setting the volume of the tone that is an octave lower than the fundamental tone. The drawbar $DB_{j=2}$ is the operator for setting the volume of the third harmonic of the tone that is an octave lower than the fundamental tone. The drawbars $DB_{j=3}$, $DB_{j=4}$, $DB_{j=5}$, $DB_{j=6}$, $DB_{j=7}$, $DB_{j=8}$, and $DB_{j=9}$ are operators for setting the volumes of the fundamental tone, the second harmonic, the third harmonic, the fourth harmonic, the fifth harmonic, the sixth harmonic, and the eighth harmonic, respectively. The drawbar $DB_j$ is constituted by a volume slider. The drawbar $DB_j$ has a knob that is operated by a performer. The drawbar $DB_j$ outputs an instruction value (voltage value) corresponding to the knob position. When the knob of the drawbar $DB_j$ is at the position closest to the performer, the instruction value of that drawbar $DB_j$ is at its maximum. On the other hand, when the knob of the drawbar $DB_j$ is at the position farthest from the performer, the instruction value of that drawbar $DB_j$ is at its minimum.

Also, for example, a rotor speed selection switch RV is included in the setting operators. The rotor speed selection switch RV is an operator for selecting whether to imitate a sound reproduced when the rotation speed of the rotor of the rotary speaker is set to "SLOW", a sound reproduced when the rotation speed is set to "FAST", or a sound reproduced when the rotation speed is set to "STOP". The rotor speed selection switch RV is constituted by two tact switches respectively corresponding to "SLOW" and "FAST". When the tact switch corresponding to "SLOW" is pressed, the instruction value of the rotor speed selection switch RV is set to "SLOW". Also, when the tact switch corresponding to "FAST" is pressed, the instruction value of the rotor speed selection switch RV is set to "FAST". Also, when the two tact switches are pressed simultaneously, the instruction value of the rotor speed selection switch RV is set to "STOP". The rotor speed selection switch RV corresponds to "an operator for setting the reproduction speed of the musical sound" of the present invention.

The control unit 12 includes a CPU 12*a*, a ROM 12*b*, and a RAM 12*c*, which are each connected to the bus BS. The CPU 12*a* reads out various types of programs to perform operations of the electronic musical instrument 10 from the ROM 12*b* and executes them. For example, in accordance with the various types of programs, the CPU 12*a* detects the operation states of the keyboard device KY, the drawbar $DB_j$, the rotor speed selection switch RV, and the like, and controls the tone generator circuit 16 based on the detection result.

In addition to the programs, the ROM 12*b* stores various types of data, such as initial setting parameters, waveform data information expressing information (head addresses, end addresses, etc.) relating to each piece of waveform data $WD^{(NN)}$, and graphical data and character data for generating display data expressing images to be displayed on the display device 13. Data needed during the execution of the various types of programs is temporarily stored in the RAM 12*c*.

The display device 13 is constituted by a liquid crystal display (LCD). The display data generated using the graphical data, character data, and the like is supplied from the control unit 12 to the display device 13. The display device 13 displays images based on the display data.

Also, the storage device 14 includes a large-capacity non-volatile recording medium such as an HDD, FDD, CD, or DVD, and a drive unit corresponding to the recording medium. The external interface circuit 15 includes a connection terminal (e.g., a MIDI input/output terminal) that allows the electronic musical instrument 10 to be connected to an external device such as another electronic musical instrument or a personal computer. The electronic musical instrument 10 can also be connected to a communication network such as a LAN (Local Area Network) or the Internet via the external interface circuit 15.

Figure 3:
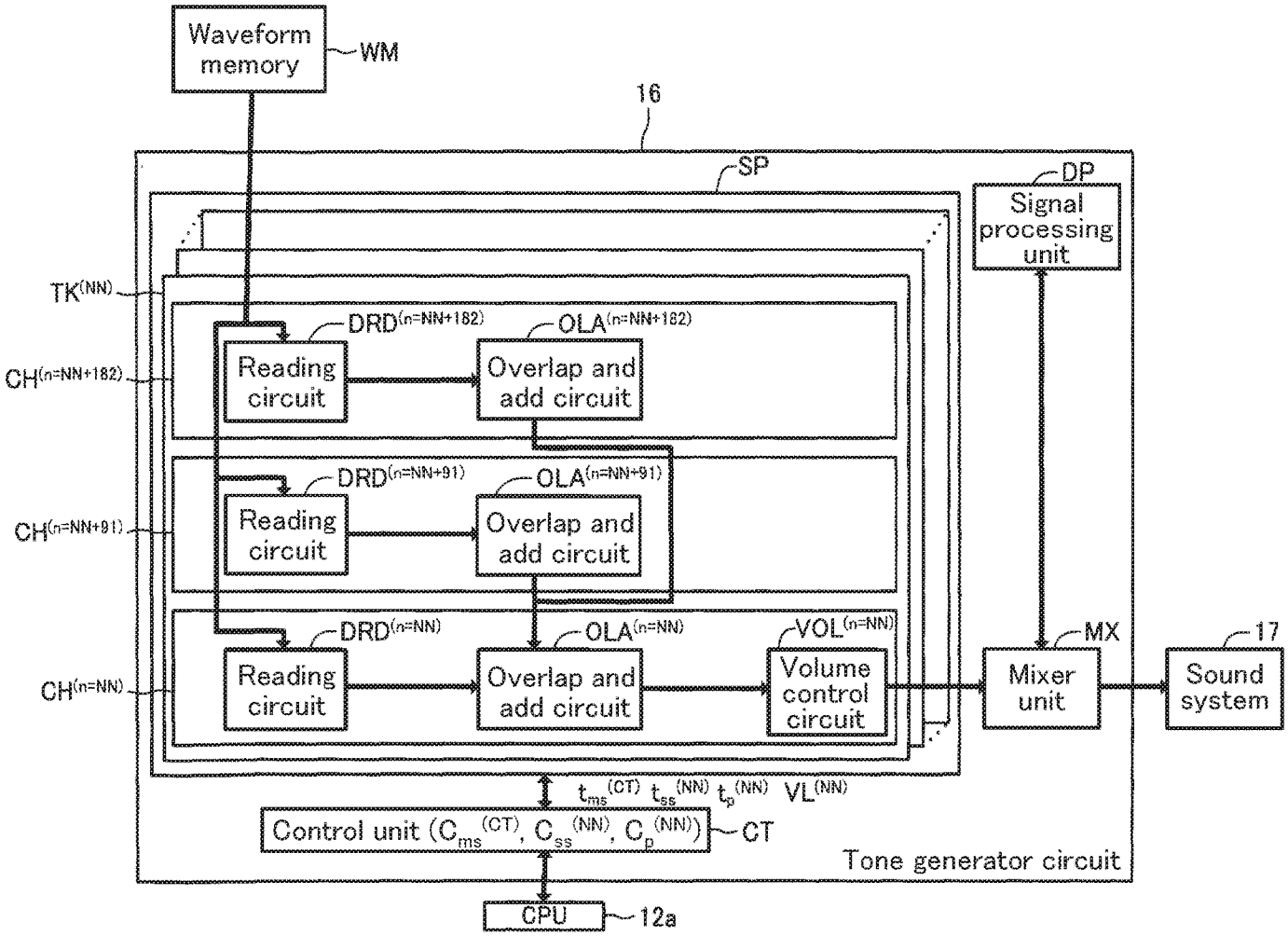
FIG. 3 is a block diagram showing a configuration of a tone generator circuit of the electronic musical instrument shown in FIG. 1.

As illustrated in FIG. 3, the tone generator circuit 16 includes a control unit CT, a sound generation unit SP, a signal processing unit DP, and a mixer unit MX.

The control unit CT controls the sound generation unit SP in accordance with instructions from the CPU 12*a*. As will be described in detail later, the control unit CT has multiple counter circuits (master sample counter $C_{ms}^{(CT)}$, slave sample counters $C_{ss}^{(NN=1\ to\ 91)}$, sampling period counters $C_P^{(NN=1\ to\ 91)}$), which are used to synchronize the reproduction speeds and phases of the musical sound signals.

The sound generation unit SP includes multiple (e.g., 273) sound generation channels $CH^{(n=1,\ 2,\ \ldots,\ 273)}$. The configurations of the tone generation channels $CH^{(n)}$ are the same. The tone generation channel $CH^{(n)}$ has a reading circuit $DRD^{(n)}$, an overlap and add circuit $OLA^{(n)}$, and a volume control circuit $VOL^{(n)}$.

Figure 11:
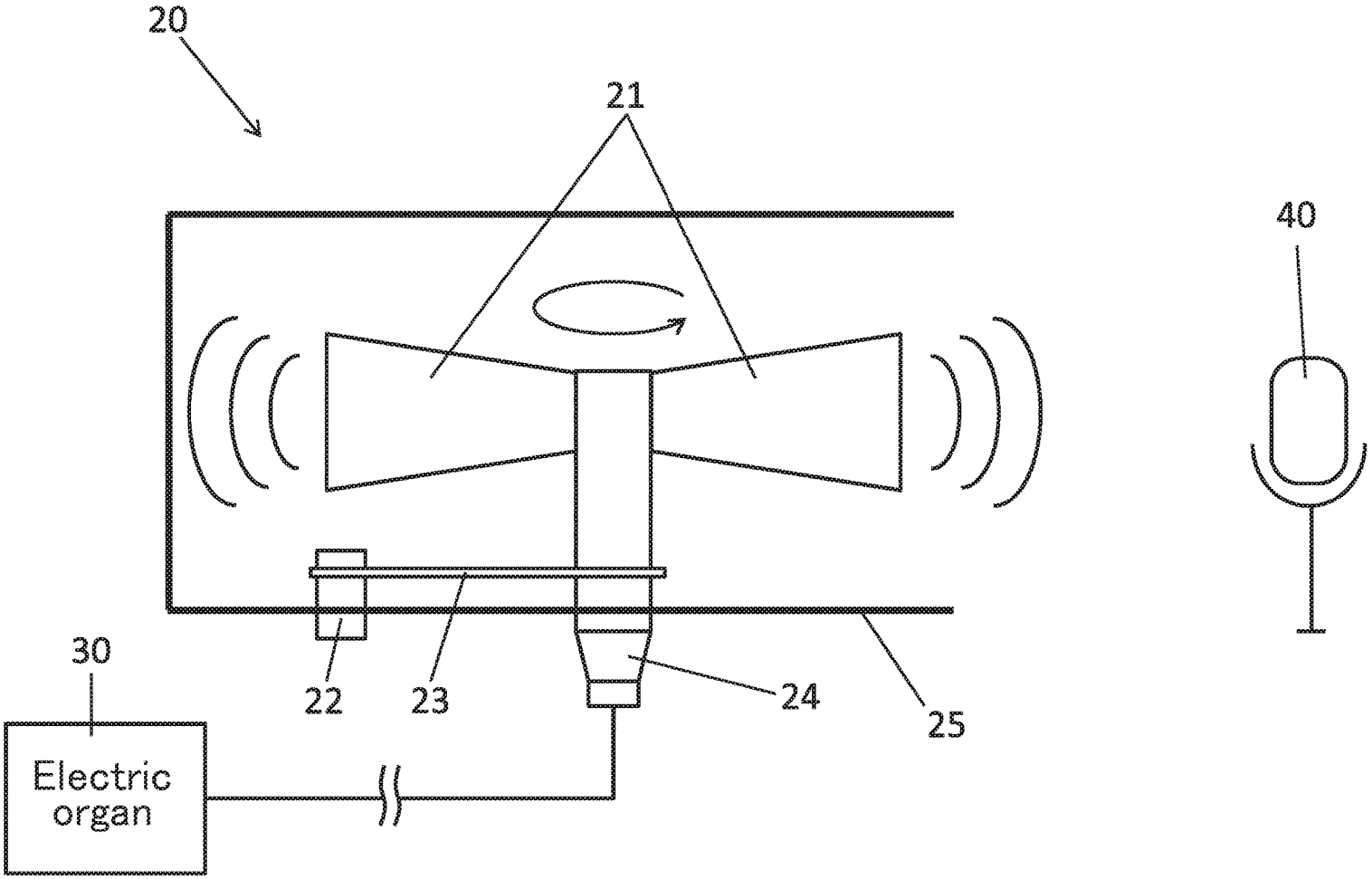
FIG. 11 schematically illustrates a scene in which waveform data is sampled.

The readout circuit $DRD^{(n)}$ is connected to the waveform memory WM. The waveform memory WM stores multiple pieces of waveform data WD expressing waveforms of musical sounds of an electric organ. The waveform data WD can be generated as follows using a rotary speaker 20 illustrated in FIG. 11. That is, as illustrated in FIG. 11, the rotary speaker 20 is connected to an electric organ 30. A known electric organ can be used as the electric organ 30, and a known rotary speaker can be used as the rotary speaker 20. The drawbars are set such that only a signal of an electromagnetic pickup of one tone wheel is output when one key is pressed on the electric organ 30. Next, the keys are pressed one-by-one, and the sounds emitted from the rotary speaker 20 are each sampled for several seconds at a predetermined sampling period (e.g., $1/44100$ of a second) using a microphone 40 placed in front of the rotary speaker 20, whereby sampling data is obtained. A known microphone can be used as the microphone 40. Note that in the example shown in FIG. 11, the rotary speaker 20 includes a cabinet 25, a (horn) rotor 21 that is contained in the cabinet 25 and is configured to be able to rotate about an axis that extends in a vertical direction, a motor 22 and pulley 23 that rotate the rotor 21 about the axis, and a speaker 24 that outputs the signal from the electric organ 30. The rotation speed of the rotor 21 can be changed to "SLOW" and "FAST". Due to the rotor 21 being rotated at a predetermined rotational speed and a musical sound from the speaker 24 being output from the rotor 21, the rotary speaker 20 applies an auditory effect (chorus, tremolo, etc.) to the reproduced musical sound. Note that when the sound is sampled, the rotational speed of the rotor 21 is set to "SLOW". By repeating this task for each tone wheel, sampling data corresponding to each tone wheel can be obtained.

Next, a portion generated while the rotor performs one rotation about the rotational axis from a state of facing a predetermined direction (e.g., the front) is cut out from each piece of sampling data obtained in the manner described above, and thus source data corresponding to one tone wheel is generated. By repeating this task for the sampling data corresponding to each tone wheel, source data for all of the tone wheels is generated. That is, one piece of source data is generated per tone wheel. In the present embodiment, the waveform memory WM stores data, which is obtained by using an apparatus other than the electronic musical instrument 10 to modify the source data as follows, as the waveform data WD. That is, the other apparatus is used to apply a pitch synchronous overlap and add method, for example, to the generated source data, whereby data indicating a state in which only the reproduction speed is doubled is generated in advance without changing the pitch and formant of the source data. The waveform memory WM stores this data as the waveform data WD. Note that loop points are set at the head and end of each piece of waveform data WD. Each piece of waveform data WD is repeatedly reproduced between the loop points. Accordingly, when the source data is cut out from the sampling data, the cutting-out position is adjusted in each piece of source data such that no noise is generated within the boundaries of the end and head of the source data when the source data is looped. For example, a position of node of a fundamental tone is set as a cutting-out position. The nodes are the positions at each of that the phase of the fundamental tone has the predetermined same value. Accordingly, there are cases where several pieces of source data are somewhat longer or shorter than the source data of a length of time exactly equal to the length of time for one rotation of the rotor. Thus, there are cases where the length is somewhat different for each piece of waveform data WD.

Figure 4:
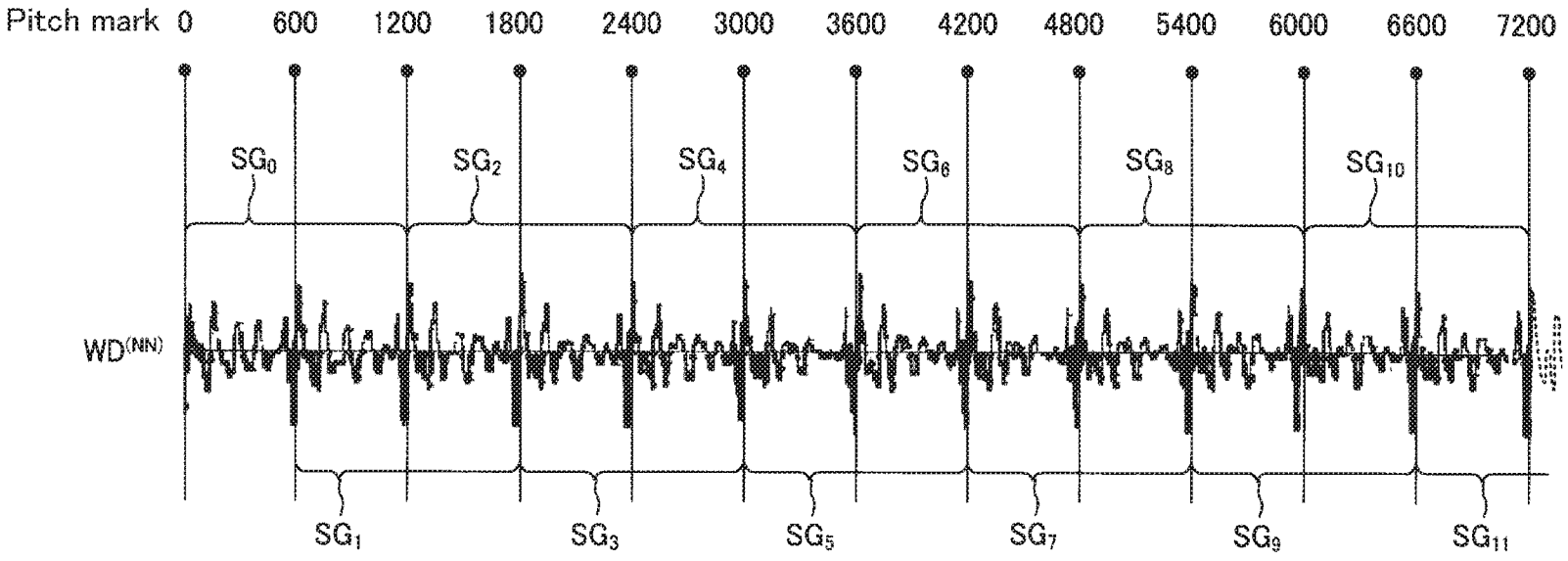
FIG. 4 is a conceptual diagram showing a configuration of waveform data.

Also, using an apparatus other than the electronic musical instrument 10, the pitches of segments of the waveform data WD are analyzed in advance, and pitch mark values that correspond to the positions of the nodes of the fundamental tone of each segment are calculated. The pitch mark values correspond to the number of samples from the head of the waveform data WD to the position of the node. That is, the pitch mark values are addresses associated with storage regions in which the sample values constituting the waveform data WD are stored, and indicate addresses corresponding to the nodes of the fundamental tone. The pitch mark values correspond to offset addresses with respect to the head addresses of the waveform data WD. For example, as illustrated in FIG. 4, if the sampling period is $1/44100$ of a second and the frequency of the fundamental tone is 73.5 Hz, the pitch mark values are "0", "600", "1200", and the like. The pitch mark values are stored in the waveform memory WM. In the example shown in FIG. 4, integers were used as the pitch mark values, but the pitch mark values may include decimal portions as well.

The readout circuit $DRD^{(n)}$ reads out a sample value from the waveform memory WM each sampling period. The readout circuit $DRD^{(n)}$ supplies the read-out sample values to the overlap and add circuit $OLA^{(n)}$.

Figure 5:
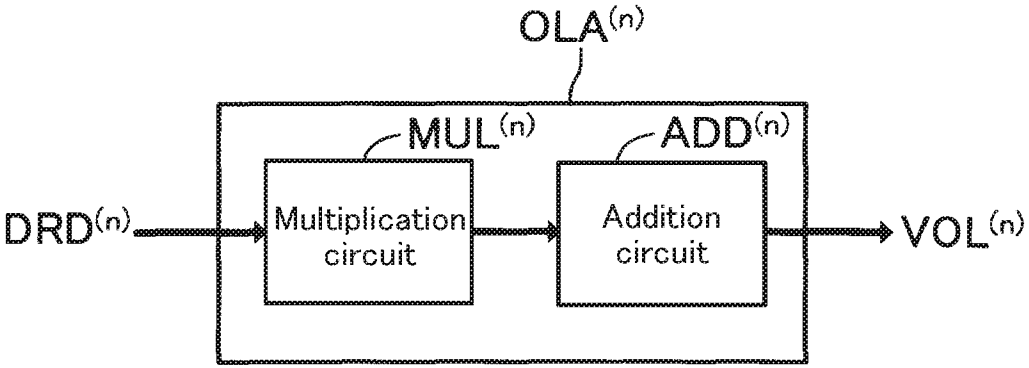
FIG. 5 is a block diagram showing a configuration of an overlap and add circuit of the tone generator circuit shown in FIG. 3.

As illustrated in FIG. 5, the overlap and add circuit $OLA^{(n)}$ includes a multiplication circuit $MUL^{(n)}$ and an addition circuit $ADD^{(n)}$. The multiplication circuit $MUL^{(n)}$ is a circuit that applies a window function such as that shown in FIG. 6 to the input signal using the multiplication circuit $MUL^{(n)}$ and the addition circuit $ADD^{(n)}$. Due to this kind of window function being applied to the input signal, the output signal of the overlap and add circuit $OLA^{(n)}$ fades in and subsequently fades out.

The addition circuits $ADD^{(n=1)}$, $ADD^{(n=2)}$, . . . , and $ADD^{(n=273)}$ are connected to each other. An addition circuit $ADD^{(n=a)}$ is configured to add a sample value supplied from a multiplication circuit $MUL^{(n=a)}$ and a sample value supplied from another addition circuit $ADD^{(n=b)}$ and to be able to supply the obtained result to yet another addition circuit $ADD^{(n=c)}$. Also, the addition circuit $ADD^{(n)}$ supplies the sample value obtained by addition to the volume control circuit $VOL^{(n)}$.

The volume control circuit $VOL^{(n)}$ amplifies the sample value supplied from the overlap and add circuit $OLA^{(n)}$ in accordance with instructions from the CPU 12*a* and outputs the result to the mixer unit MX.

The signal processing unit DP applies effects such as reverb and delay to the sound expressed by the input waveform data and outputs the result.

Each sampling period, the mixer unit MX adds the sample value supplied from the tone generation channels $CH^{(n=1)}$, $CH^{(n=2)}$, . . . ,$CH^{(n=273)}$, and the signal processing unit DP and supplies the result to the sound system 17.

The sound system 17 includes a D/A converter that converts a digital sound signal supplied from the mixer unit MX into an analog sound signal and an output terminal that outputs the converted analog sound signal to an external device (a power amplifier, etc.).

Operation Example

Next, an operation example of the electronic musical instrument 10 will be described. The electronic musical instrument 10 according to the present embodiment reproduces a musical sound signal corresponding to one note number NN using a track TK constituted by three tone generation channels CH. The electronic musical instrument 10 includes 273 tone generation channels CH, and therefore can include 91 tracks TK. One note number NN is assigned per track TK. Hereinafter, a track TK corresponding to a note number NN (="1" to "91") will be denoted as "track $TK^{(NN)}$". Also, the track $TK^{(NN)}$ is constituted by tone generation channels $CH^{(n=NN)}$, $CH^{(n=NN+91)}$, and $CH^{(n=NN+182)}$ (see FIG. 3).

With an electric organ, all of the tone wheels are always rotating, and when a key is pressed, the output signals of the magnetic pickups of multiple tone wheels corresponding to the pressed key are added together and the added output signal is reproduced as a musical sound. In contrast to this, in the electronic musical instrument 10, all of the tracks $TK^{(NN=1\ to\ 91)}$ always output musical sound signals. However, in the state in which no key of the keyboard device of the electronic musical instrument 10 is pressed, the volumes of all of the tracks TK are set to "0". When a key is operated, the note numbers NN of the other eight harmonics whose fundamental tone is the pitch of that key are calculated. Then, the volumes of the nine tracks $TK^{(NN)}$ corresponding to the note numbers NN of the fundamental tone and the harmonics are changed according to the operation states of the drawbars $DB_{j=1,\ 2,\ .\ .\ .\ ,\ 9}$. Accordingly, the electronic musical instrument 10 according to the present embodiment imitates the operation of the above-described electric organ. Note that the phases of the musical sound signals reproduced by the tracks TK are approximately synchronous. Also, the reproduction speeds of the musical sound signals of the tracks TK are approximately synchronous.

The tone generation channels $CH^{(n=NN)}$, $CH^{(n=NN+91)}$, $CH^{(n=NN+182)}$ of the track $TK^{(NN)}$ each generate a signal (hereinafter referred to as grains $GR_{i=0,\ 1,\ 2,\ .\ .\ .}$) of a portion of the musical sound signal. The grains $GR_i$ generated by the tone generation channels $CH^{(n=NN)}$, $CH^{(n=NN+91)}$, and $CH^{(n=NN+182)}$ are subjected to overlap and add by the tone generation channels $CH^{(n=NN)}$ and are supplied to the mixer unit MX as one musical sound signal.

Figure 6:
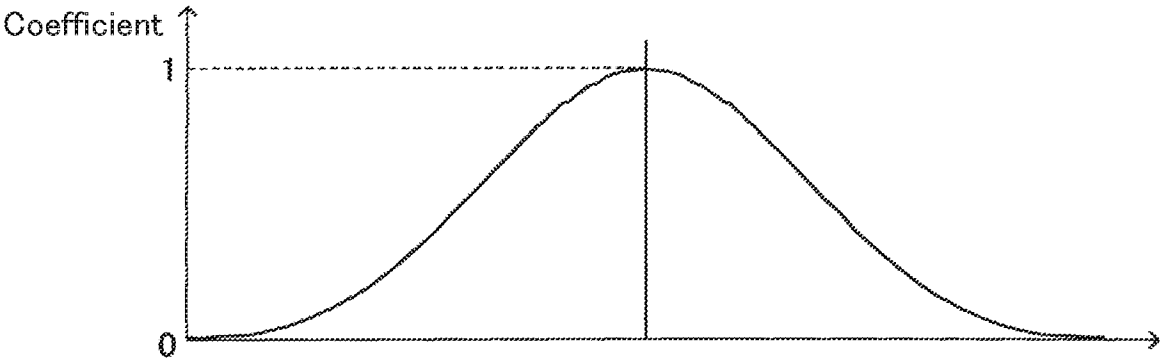
FIG. 6 is a graph showing a window function applied to a segment.

The grains $GR_i$ are partial segments of the waveform data $WD^{(NN)}$ corresponding to the note number NN, and correspond to waveform data formed by applying the window function illustrated in FIG. 6 to segments corresponding to the length of two periods of the fundamental tone (hereinafter referred to as segments $SG_{i=0,\ 1,\ 2,\ .\ .\ .}$ (see FIG. 4)). The addresses of the head and end of the segment $SG_i$ coincide with pitch mark values. Accordingly, the address of the center of the segment $SG_i$ also coincides with a pitch mark value. In the following description, pitch marks located at the center of the segment $SG_i$ are referred to as "central pitch marks". Also, the segment $SG_i$ is cut out from the original waveform data such that a foregoing portion of the segment $SG_i$ and a latter portion of the segment $SG_{i-1}$ are the same.

Figure 7:
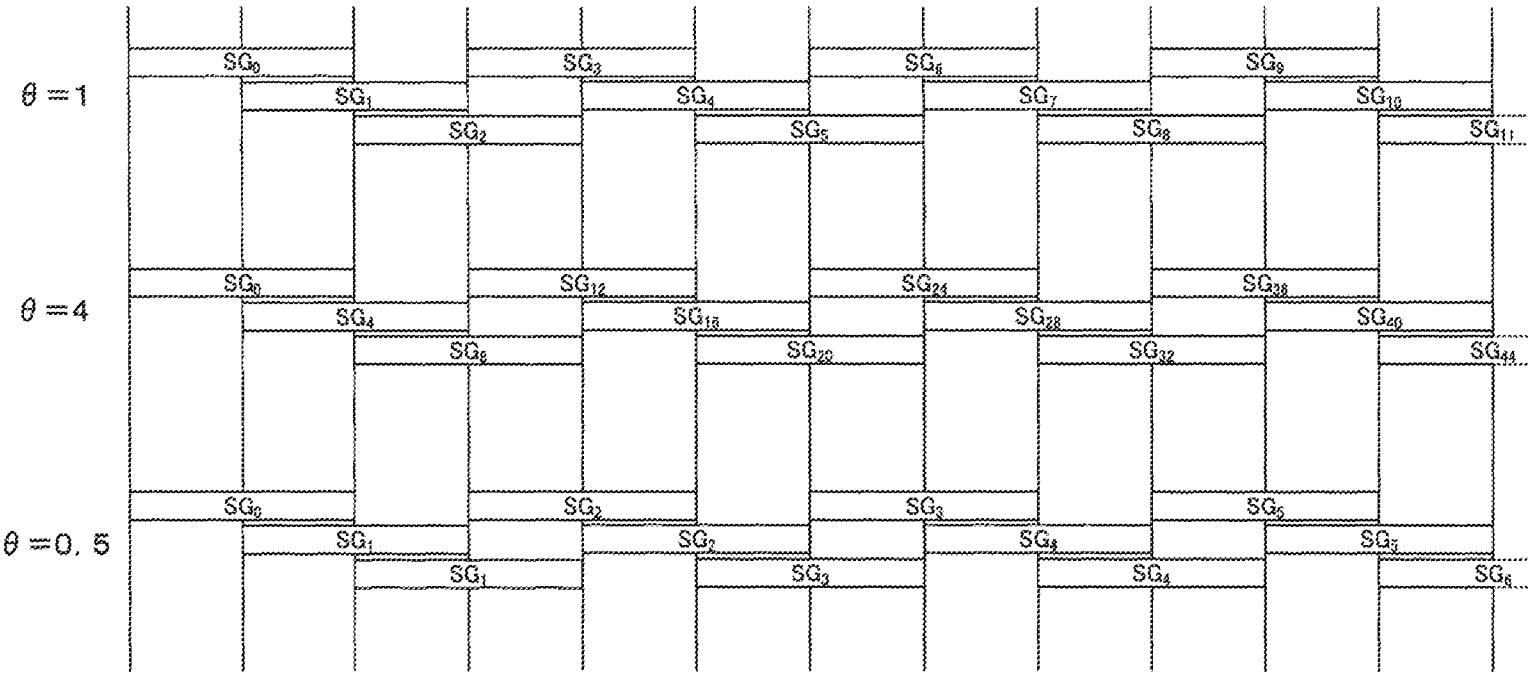
FIG. 7 is a conceptual diagram showing an order of segments cut out from the waveform data.

The tone generation channels $CH^{(n=NN)}$, $CH^{(n=NN+91)}$, and $CH^{(n=NN+182)}$ operate cyclically to reproduce the grains $GR_i$. That is, as illustrated in FIG. 7, when one grain $GR_i$ is reproduced in one tone generation channel $CH^{(n)}$ up to the central pitch mark, another tone generation channel $CH^{(n)}$ starts to newly reproduce a grain $GR_i$. The indexes i of the grains $GR_i$ generated by the tone generation channels $CH^{(n=NN)}$, $CH^{(n=NN+91)}$, and $CH^{(n=NN+182)}$ are determined according to the reproduction speed. If the reproduction speed is slow, the indexes i repeatedly have the same values. That is, the same segment $SG_i$ is repeatedly cut out from the original waveform data $WD^{(NN)}$. Accordingly, the amount of time for reproducing the original waveform data $WD^{(NN)}$ increases. In other words, the reproduction speed of the musical sound signal is slower (the waveform data $WD^{(NN)}$ is extended). On the other hand, if the reproduction speed is fast, the values of the index i are not consecutive and some segments $SG_i$ are skipped. That is, parts of the original waveform data $WD^{(NN)}$ are skipped over. Accordingly, for example, the amount of time for reproducing the original waveform data $WD^{(NN)}$ decreases. In other words, the reproduction speed of the musical sound signal is faster (the waveform data $WD^{(NN)}$ is shortened). With this kind of adjustment of the reproduction speed, the electronic musical instrument imitates a musical sound emitted from a rotor rotating at a predetermined rotation speed. Specifically, the units of the electronic musical instrument 10 operate as follows.

CPU

Figure 8:
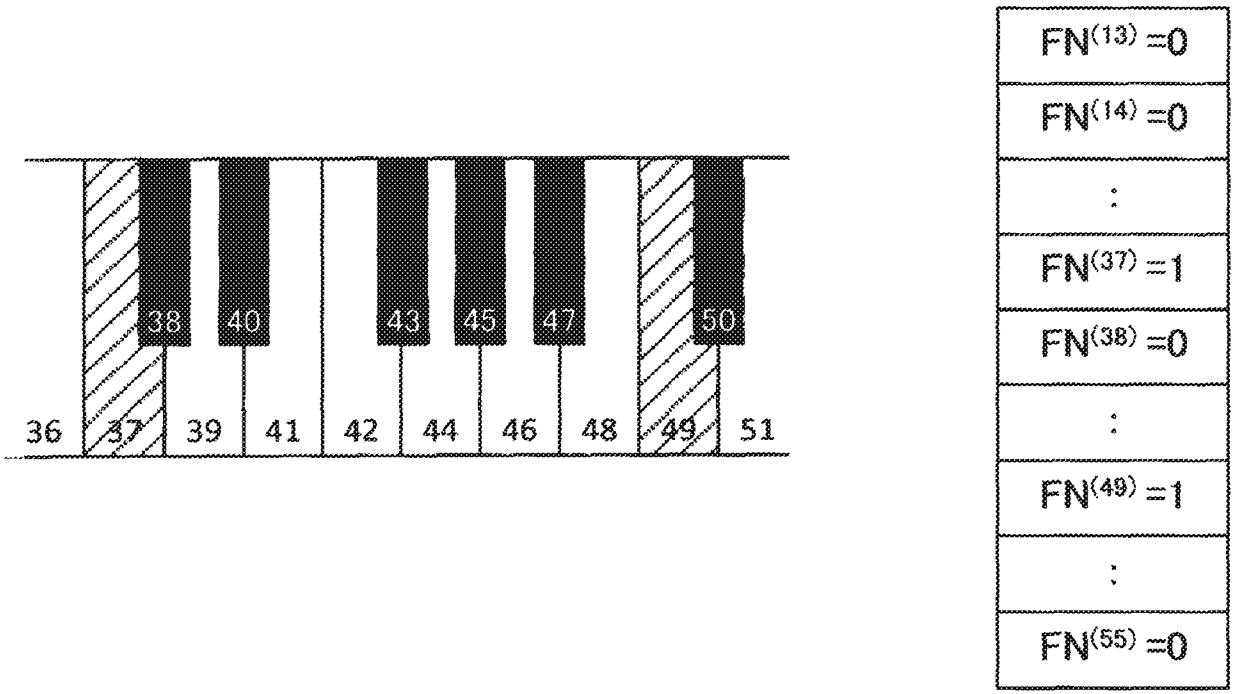
FIG. 8 is a table showing an example of values of note-on flags.

First, operations of the CPU 12*a* will be described. When the power source of the electronic musical instrument 10 is turned on, the CPU 12*a* sets note-on flags $FN^{(NN=13\ to\ 55)}$, which indicate whether or not the keys to which the note numbers NN are assigned are being pressed, to "0". When the performer presses one of the keys of the keyboard device, the CPU 12*a* detects the note number NN assigned to the pressed key. Then, as illustrated in FIG. 8, the CPU 12*a* sets the note-on flag $FN^{(NN)}$ corresponding to the detected note number NN to "1". On the other hand, when the performer releases the key that was pressed, the CPU 12*a* detects the note number NN assigned to the released key. Then, the CPU 12*a* sets the note-on flag $FN^{(NN)}$ corresponding to the detected note number NN to "0". Note that the example shown in FIG. 8 shows a state of the note-on flags $FN^{(NN)}$ when the keys with the note numbers "37" and "49" are pressed.

Also, the CPU 12*a* calculates volume values $VL^{(NN)}$ relating to the note numbers NN at a predetermined time interval (e.g., every 10 milliseconds) and supplies them to the tone generator circuit 16. The volume values $VL^{(NN)}$ are calculated based on the following equation (1) using the note-on flags $FN^{(NN)}$ and current instruction values $DV_j$ of the drawbars $DB_j$.

$$VL^{(NN)} = FN^{(NN-36)} \cdot DV_9 + FN^{(NN-31)} \cdot DV_8 + FN^{(NN-28)} \cdot DV_7 + FN^{(NN-24)} \cdot DV_6 + FN^{(NN-19)} \cdot DV_5 + FN^{(NN-12)} \cdot DV_4 + FN^{(NN)} \cdot DV_3 + FN^{(NN-7)} \cdot DV_2 + FN^{(NN+12)} \cdot DV_1 \quad (1)$$

Note that the note-on flags $FN^{(NN<13)}$ and the note-on flags $FN^{(NN>55)}$ are set to "0".

When the performer operates the rotor speed selection switch RV, the CPU 12*a* detects the instruction value ("SLOW", "FAST", or "STOP") of the rotor speed selection switch RV. The CPU 12*a* sets a master reproduction speed factor θ according to the detection result. The master reproduction speed factor θ corresponds to the factor of the speed at which the waveform data (hereinafter referred to as reference waveform data) of a length of time equal to the length of time it takes for a rotor of a rotary speaker to perform one rotation when the rotation speed switch of the rotor of the rotary speaker to be imitated is set to "SLOW". Note that the reference waveform data is virtual data for describing the present embodiment and approximately matches the source data. In the first embodiment, the waveform memory WM stores waveform data generated by doubling the reproduction speed of the source data and does not necessarily store the reference waveform data. When the reference waveform data is reproduced at its original length (speed), the master reproduction speed factor θ is "1.0". When the reference waveform data is reproduced at half of its original length (double speed), the master reproduction speed factor θ is "2.0". Here, in the first embodiment, the waveform data WD stored in the waveform memory WM is, as described above, generated by doubling only the reproduction speed of the source data. For this reason, when the instruction value of the rotor speed selection switch RV indicates "SLOW", the CPU 12*a* sets the master reproduction speed factor θ to "0.5" and supplies it to the tone generator circuit 16. On the other hand, when the instruction value of the rotor speed selection switch RV indicates "FAST", the CPU 12*a* sets the master reproduction speed factor θ to "4" and supplies it to the tone generator circuit 16. Also, when the instruction value of the rotor speed selection switch RV indicates "STOP", the CPU 12*a* sets the master reproduction speed factor θ to "0" and supplies it to the tone generator circuit 16. Furthermore, after the instruction value of the rotor speed selection switch RV is changed, the CPU 12*a* gradually changes the value of the master reproduction speed factor θ from the value before the change to the value resulting from the change. At this time, the master reproduction speed factor θ may include a decimal portion.

Control unit of tone generator circuit

Next, the operation of the control unit CT of the tone generator circuit 16 will be described. When the power source of the electronic musical instrument 10 is turned on, the control unit CT of the tone generator circuit 16 sets a count value $t_{ms}^{(CT)}$ of the master sample counter $C_{ms}^{(CT)}$ to "0". Also, the control unit CT sets the count values $t_{ss}^{(NN=1\ to\ 91)}$ of the slave sample counters $C_{ss}^{(NN=1\ to\ 91)}$ to "0". Also, the control unit CT sets the count values $t_p^{(NN=1\ to\ 91)}$ of the sampling period counters $C_p^{(NN=1\ to\ 91)}$ for counting the number of sampling periods that have elapsed to "0".

Also, the control unit CT updates the count values $t_p^{(NN)}$ by incrementing the count values $t_p^{(NN)}$ each sampling period (e.g., every 1/44100 of a second). Note that if the count value $t_p^{(NN)}$ exceeds the total number of sample values constituting the waveform data $WD^{(NN)}$ corresponding to the note number NN, the control unit CT subtracts the total number of the sample values from the count value $t_p^{(NN)}$.

Also, the control unit CT updates the count value $t_{ms}^{(CT)}$ by adding the master reproduction speed factor θ to the count value $t_{ms}^{(CT)}$ each sampling period. Note that if the count value $t_{ms}^{(CT)}$ exceeds an ideal number of samples, the control unit CT subtracts the ideal number of samples from the count value $t_{ms}^{(CT)}$. The ideal number of samples can be specified based on the sampling rate, the rotation rate of the rotor to be recorded, and the rotation speed. For example, if a sound generated while a rotor that rotates 100 times a minute rotates once is sampled at 44.1 kHz, the ideal number of samples is 26460. The count value $t_{ms}^{(CT)}$ of the master sample counter $C_{ms}^{(CT)}$ indicates the reproduction position serving as a reference for reproducing the pieces of waveform data WD with the phases of the rotor aligned. Note that in the pieces of the waveform data WD, there is a possibility that time shifting will occur even in data corresponding to the same number of rotations (e.g., one rotation) due to circumstances such as the state of the motor during recording.

In view of this, the control unit CT updates the count value $t_{ss}^{(NN)}$ by adding a value obtained by multiplying the master reproduction speed factor θ and a slave reproduction speed factor $\varphi^{(NN)}$ to the count value $t_{ss}^{(NN)}$ each sampling period. The count values $t_{ss}^{(NN)}$ of the slave sample counters $C_{ss}^{(NN)}$ indicates the reproduction positions of the pieces of waveform data WD. Here, the slave reproduction speed factor $\varphi^{(NN)}$ corresponds to the ratio of the length of the waveform data $WD^{(NN)}$ with respect to the length of reference waveform data. That is, by multiplying the slave reproduction speed factor $\varphi^{(NN)}$, the above-described time shifting is corrected. Note that if the count value $t_{ss}^{(NN)}$ exceeds the total number of sample values constituting the waveform data $WD^{(NN)}$ corresponding to the note number NN, the control unit CT subtracts the total number of the sample values from the count value $t_{ss}^{(NN)}$.

Sometimes the ratio of one or more count values among the count values $t_{ss}^{(NN=1)}$, $t_{ss}^{(NN=2)}$, . . . with respect to the count value $t_{ms}^{(CT)}$ shifts from an ideal value for some reason (e.g., the number of digits in the decimal portion being limited). In this case, the reproduction speed of the track TK in which the shifting has occurred is corrected as follows such that the shifting is included within a predetermined allowed range. Here, the ratio between the count value $t_{ms}^{(CT)}$ and the count value $t_{ss}^{(NN)}$ is shifted from an ideal value, and the shifting is outside of the allowed range. In this case, the control unit CT adds a value obtained by furthermore adding a predetermined correction factor Ψ to a value obtained by multiplying the master reproduction speed factor θ and the slave reproduction speed factor $\varphi^{(NN)}$, to the count value $t_{ss}^{(NN)}$. The correction factor Ψ is supplied in advance from the CPU 12*a* to the control unit CT. For example, the correction factor Ψ is set to "1.19" and "1/1.19". When the reproduction position of the track $TK^{(NN)}$ is behind the reproduction position of another track TK, the control unit CT multiplies a value obtained by multiplying the master reproduction speed factor θ and the slave reproduction speed factor $\varphi^{(NN)}$ by 1.19, and adds the resulting value to the count value $t_{ss}^{(NN)}$. In other words, the reproduction speed of the track $TK^{(NN)}$ is increased. On the other hand, if the reproduction position of the track $TK^{(NN=k)}$ has advanced excessively with respect to the reproduction position of another track $TK^{(NN\neq k)}$, the control unit CT multiplies a value obtained by multiplying the master reproduction speed factor θ and the slave reproduction speed factor $\varphi^{(NN)}$ by 1/1.19 and adds the resulting value to the count value $t_{ss}^{(NN)}$. In other words, the reproduction speed of the track $TK^{(NN)}$ is reduced. Thus, the count value $t_{ss}^{(NN)}$ is approximately synchronous with the count value $t_{ms}^{(CT)}$.

Then, if the count value $t_p^{(NN)}$ exceeds a pitch mark of the waveform data $WD^{(NN)}$, the control unit CT starts the generation of a new grain $GR_i$ that corresponds to the segment $SG_i$ that uses the pitch mark value immediately before the count value $t_{ss}^{(NN)}$ as the origin on the corresponding track $TK^{(NN)}$. At this time, as illustrated in FIG. 7, the control unit CT sequentially causes the three tone generation channels $CH^{(n=NN)}$, $CH^{(n=NN+91)}$, and $CH^{(n=NN+182)}$ included in the track $TK^{(NN)}$ to generate new grains $GR_i$. For example, if the tone generation channel $CH^{(n=NN)}$ is generating a grain $GR_i$ according to a previous command when a command is generated, the control unit CT causes the next tone generation channel $CH^{(n=NN+91)}$ to generate a new grain $GR_i$.

Here, the count value $t_{ss}^{(NN)}$ is a value obtained by the master reproduction speed factor θ being reflected in the count value $t_p^{(NN)}$. For this reason, as shown in FIG. 7, the segment $SG_i$ in which the grain $GR_i$ is generated is selected according to the master reproduction speed factor θ. For example, a case is envisioned in which the control unit CT causes the tone generation channel $CH^{(n=NN)}$ to generate the grain $GR_0$ of the segment $SG_0$ for the waveform data WD illustrated in FIG. 4, and thereafter causes the next tone generation channel $CH^{(n=NN+91)}$ to generate a new grain $GR_i$. For the sake of convenience in the description, it is assumed that the slave reproduction speed factor $\varphi^{(NN)}$ is "1". In this case, if the instruction value of the rotor speed selection switch RV is set to "SLOW" (i.e., if the master reproduction speed factor θ is set to "0.5"), the count value $t_{ss}^{(NN)}$ is "300" when the count value $t_p^{(NN)}$ is "600". For this reason, if the instruction value of the rotor speed selection switch RV is set to "SLOW", the control unit CT repeatedly instructs the track $TK^{(NN)}$ to generate grains GR corresponding to the same segment SG. On the other hand, for example, if the instruction value of the rotor speed selection switch RV is set to "FAST" (i.e., if the master reproduction speed factor θ is set to "4"), the count value $t_{ss}^{(NN)}$ is "2400" when the count value $t_p^{(NN)}$ is "600". For this reason, at this time, the control unit CT causes the tone generation channel $CH^{(n=NN+91)}$ to generate the grain $GR_4$ of the segment $SG_4$ while skipping the segments $SG_1$ to $SG_3$. That is, if the instruction value of the rotor speed selection switch RV is set to "FAST", the control unit CT instructs the track $TK^{(NN)}$ to generate the grains $GR_i$ while skipping some segments $SG_i$. Also, if the readout address reaches the end of one segment $SG_i$, the control unit CT stops the operation of the tone generation channel $CH^{(n)}$ generating the grain $GR_i$ of that segment $SG_i$.

Also, as described above, the control unit CT receives the volume values $VL^{(NN=1\ to\ 91)}$ from the CPU 12*a* at the predetermined time interval. Also, the control unit CT sets the amplification degree of the volume value control circuit $VOL^{(n=NN)}$ of the tone generation channel $CH^{(n=NN)}$ of the track $TK^{(NN)}$ in accordance with the volume value $VL^{(NN)}$.

Tone generation channel of tone generator circuit

Next, operations of the three tone generation channels $CH^{(n=NN)}$, $CH^{(n=NN+91)}$, and $CH^{(n=NN+182)}$ included in the tone generator circuit 16 will be described. Note that the operations of the tone generation channels $CH^{(n=NN+91)}$ and $CH^{(n=NN+182)}$ are similar to the operations of the tone generation channel $CH^{(n=NN)}$. For this reason, in the description below, for the sake of convenience in the description, the operations of the tone generation channel $CH^{(n=NN)}$ will be described representatively.

When the tone generation channel $CH^{(n=NN)}$ is instructed to start the generation of the grain $GR_i$ by the control circuit CT, the reading circuit $DRD^{(n=NN)}$ reads out a sample value from the waveform memory WM each sampling period and supplies it to the overlap and add circuit $OLA^{(n=NN)}$. The readout address of the sample value is initialized to a value obtained by adding the value of the integer portion of the pitch mark value of the origin to the head address of the waveform data $WD^{(n=NN)}$. Thereafter, the tone generation channel $CH^{(n=NN)}$ increments the readout address each sampling period and reads out the sample value at that address of the waveform data $WD^{(n=NN)}$ until receiving an operation stop instruction from the control unit CT. The multiplication circuit $MUL^{(n=NN)}$ of the overlap and add circuit $OLA^{(n=NN)}$ multiplies the sample value supplied from the reading circuit $DRD^{(n=NN)}$ by a coefficient calculated based on the window function illustrated in FIG. 6. In this manner, the tone generation channel $CH^{(n=NN)}$ generates the sample value of the grain $GR_i$ each sampling period. The tone generation channel $CH^{(n=NN+91)}$ and the tone generation channel $CH^{(n=NN+182)}$ generate the grains $GR_i$ in accordance with a control sequence similar to that of the tone generation channel $CH^{(n=NN)}$. The sample values of the grains $GR_i$ generated by the tone generation channel $CH^{(n=NN+91)}$ and the tone generation channel $CH^{(n=NN+182)}$ are supplied to the addition circuit $ADD^{(n=NN)}$ of the tone generation channel $CH^{(n=NN)}$. The tone generation channel $CH^{(n=NN)}$ adds the sample values of the grains GR generated in the same sampling period by the tone generation channels $CH^{(n=NN)}$, $CH^{(n=NN+91)}$, and $CH^{(n=NN+182)}$ and supplies them to the mixer unit MX.

At this time, the indexes i of the segments $SG_i$ of the grains $GR_i$ generated by the tone generation channels $CH^{(n=NN)}$, $CH^{(n=NN+91)}$, and $CH^{(n=NN+182)}$ are selected according to the instruction value of the rotor speed selection switch RV, as described above. Specifically, if the instruction value of the rotor speed selection switch RV is set to "FAST", the tone generation channels $CH^{(n=NN)}$, $CH^{(n=NN+91)}$, and $CH^{(n=NN+182)}$ generate the grains $GR_i$ of the target segments $SG_i$ while skipping some of the segments $SG_i$. On the other hand, if the instruction value of the rotor speed selection switch RV is set to "SLOW", the tone generation channels $CH^{(n=NN)}$, $CH^{(n=NN+91)}$ and $CH^{(n=NN+182)}$ repeatedly generate grains $GR_i$ corresponding to the same segment $SG_i$. Accordingly, the tone generator circuit 16 can change the reproduction speed of the musical sound signal corresponding to waveform data $WD^{(NN)}$ without changing the pitch and formant. Also, by reproducing such a musical sound signal whose reproduction speed was changed without changing the pitch and formant thereof at a predetermined volume, the electronic musical instrument 10 can imitate a musical sound emitted from a rotor that rotates at a predetermined rotation speed.

Characteristics

The electronic musical instrument 10 according to the first embodiment uses waveform data expressing a musical sound emitted from a rotary speaker while a rotor rotates by a predetermined angle, and therefore the effect of the rotary speaker can be imitated reliably. Also, the electronic musical instrument 10 according to the first embodiment reproduces the musical sound signal by repeatedly reading out waveform data $WD^{(NN)}$ indicating a musical sound emitted from a rotary speaker while a rotor performs approximately one rotation. At this time, as described above, according to the instruction value of the rotor speed selection switch RV, the electronic musical apparatus 10 skips a portion of segments $SG_i$ to be reproduced in the tracks $TK^{(NN)}$ or repeatedly reproduces the same segment $SG_i$, thereby changing the reproduction speed of the waveform data $WD^{(NN)}$. Accordingly, with the first embodiment, no complicated calculation such as a convolution calculation is needed, and therefore it is possible to suppress the component cost. Accordingly, with the first embodiment, it is possible to provide a low-cost musical sound signal generation apparatus capable of reliably imitating the sound of an electric organ emitted from a rotary speaker.

In addition, with the electronic musical instrument 10 according to the present embodiment, when the instruction value of the rotor speed selection switch RV is switched from "FAST" to "SLOW", "SLOW" to "FAST", or the like, the CPU 12*a* of the control unit 12 gradually changes the value of the master reproduction speed factor θ from the value before the change to the value resulting from the change. In other words, when the instruction value of the rotor speed selection switch RV is switched, the value added to the count value $t_{ss}^{(NN)}$, which is the reference for determining the index i of the segment $SG_i$ reproduced in the tracks $TK^{(NN)}$, is changed gradually. For this reason, with the present embodiment, the extension/shortening rate of the reproduction speed of the musical sound signal that is extended or shortened using the time stretching function is changed gradually. Accordingly, the electronic musical instrument 10 according to the present embodiment can imitate a musical sound emitted from a rotor whose rotational speed is changing gradually.

Also, the phase of each musical sound signal corresponds to the rotation angle of the rotor of the rotary speaker. In the first embodiment, the count value $t_{ms}^{(CT)}$ of the master sample counter $C_{ms}^{(CT)}$ corresponds to the rotation angle of the rotor. Also, the count value $t_{ss}^{(NN)}$ of the slave sample counter $C_{ss}^{(NN)}$ is approximately synchronous with the count value $t_{ms}^{(CT)}$ of the master sample counter $C_{ms}^{(CT)}$. In other words, in the tracks $TK^{(NN)}$, sample values stored at addresses that correspond to each other are read out. In other words, the phases of the reproduced musical sounds are approximately synchronous. That is, the musical sound signals generated by the tracks $TK^{(NN)}$ represent musical sounds in a state in which the rotor of a rotary speaker is facing approximately the same direction. Accordingly, with the first embodiment, it is possible to reliably imitate a state in which multiple musical sounds are emitted from one rotor.

Second Embodiment

Next, an electronic musical instrument 10A according to a second embodiment of the present invention will be described. In the first embodiment, the index n of a tone generation channel $CH^{(n)}$ assigned to a track $TK^{(NN)}$ is determined in advance. That is, tone generation channels $CH^{(n=NN)}$, $CH^{(n=NN+91)}$, and $CH^{(n=NN+192)}$ are assigned to the track $TK^{(NN)}$. Also, all of the tracks $TK^{(NN=1\ to\ 91)}$ always reproduce musical sound signals. In contrast to this, in the second embodiment, the tone generation channels $CH^{(n)}$ are assigned to the tracks $TK^{(NN)}$ dynamically. In other words, the tracks $TK^{(NN)}$ are formed dynamically. Other configurations are similar to those in the first embodiment.

Figure 9:
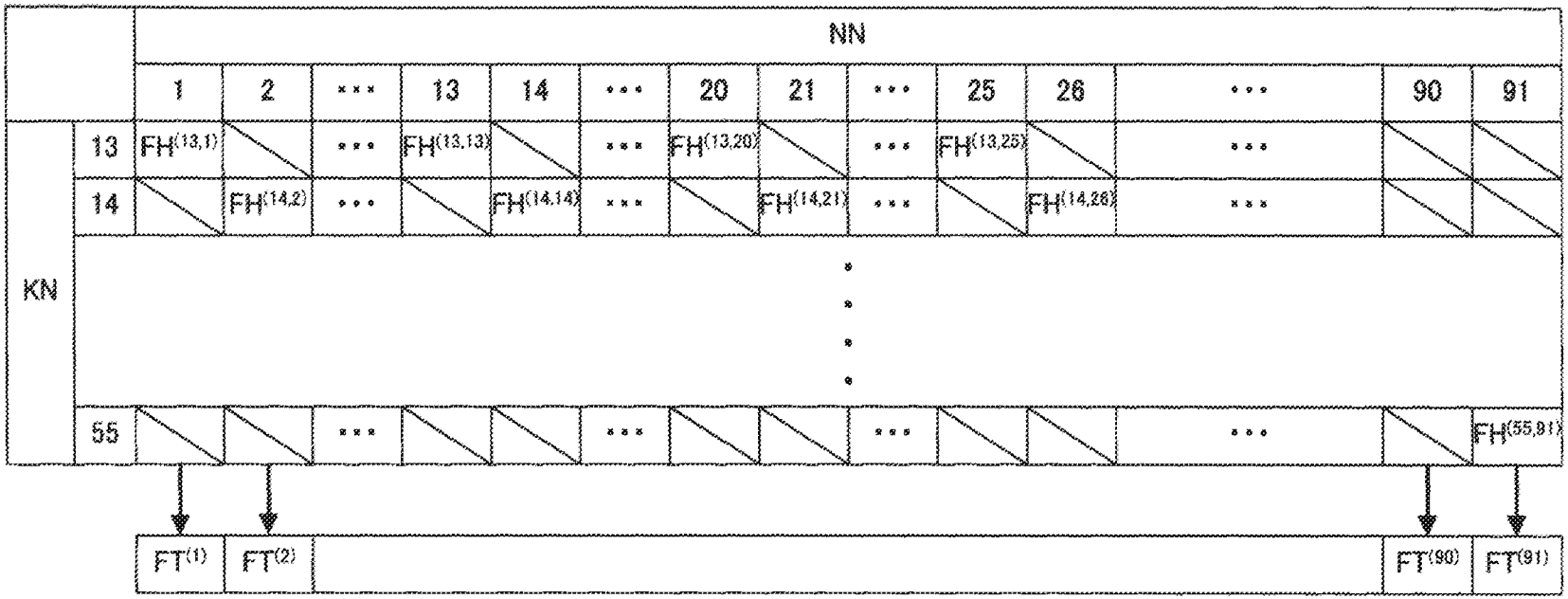
FIG. 9 is a table showing a relationship between harmonic flags and track-on flags.

Note that in the second embodiment, for the sake of convenience, a note number assigned to a pressed key is denoted as "note number KN", and a note number corresponding to a harmonic of that key is denoted as "note number NN". Also, as illustrated in FIG. 9, in the second embodiment, harmonic flags $FH^{(KN=13\ to\ 55,\ NN=1\ to\ 91)}$ and track-on flags $FT^{(NN=1\ to\ 91)}$ are used in addition to the note-on flags $FN^{(KN=13\ to\ 55)}$.

The hardware configuration of the electronic musical instrument 10A is similar to that of the first embodiment (see FIGS. 1 to 3). Also, the configurations and operations relating to the note-on flags $FN^{(KN=13\ to\ 55)}$ are similar to those of the first embodiment. On the other hand, due to including harmonic flags $FH^{(KN=13\ to\ 55,\ NN=1\ to\ 91)}$ and track-on flags $FT^{(NN=1\ to\ 91)}$ in addition to the note-on flags $FN^{(KN=13\ to\ 55)}$, the CPU 12*a* of the electronic musical instrument 10A operates as follows.

That is, the harmonic flags $FH^{(KN=13\ to\ 55,\ NN=1\ to\ 91)}$ are set to "0" when the power source of the electronic musical instrument 10A is turned on. When a key with the note number KN is pressed, the CPU 12*a* sets the harmonic flags $FH^{(KN,NN)}$ corresponding to the note numbers NN of the fundamental tone and the eight harmonics set to the sound-generating state to "1". Conversely, when the key with the note number KN is released, the CPU 12*a* sets the harmonic flags $FH^{(KN,NN)}$ corresponding to the note number NN of the fundamental tone and the eight harmonics set to the sound-generating state to "0". Accordingly, when the key with the note number KN is pressed, the harmonic flags $FH^{(KN,NN=KN-12)}$, $FH^{(KN,NN=KN+7)}$, $FH^{(KN,NN=KN)}$, $FH^{(KN,NN=KN+12)}$, $FH^{(KN,NNKN+19)}$, $FH^{(KN,NN=KN+24)}$, $FH^{(KN,NN=KN+28)}$, $FH^{(KN,NN=KN+31)}$, and $FH^{(KN,NN=KN+36)}$ are set to "1". Accordingly, when the key with the note number KN is released, the harmonic flags $FH^{(KN,NN=KN-12)}$, $FH^{(KN,NN=KN+7)}$, $FH^{(KN,NN=KN)}$, $FH^{(KN,NN=KN+12)}$, $FH^{(KN,NN=KN+19)}$, $FH^{(KN,NN=KN+24)}$, $FH^{(KN,NN=KN+28)}$, $FH^{(KN,NN=KN+31)}$, and $FH^{(KN,NN=KN+36)}$ are set to "0". Note that it is sufficient that nine harmonic flags FH are provided per note number KN, as described above. For this reason, a harmonic flag FH relating to a note number NN that cannot be a harmonic of the note number KN (a harmonic flag $FH^{(KN,NN)}$ that corresponds to a portion denoted by a diagonal line in FIG. 9) may be omitted.

The track-on flags $FT^{(NN=1\ to\ 91)}$ are flags indicating the operation states of the tracks $TK^{(NN)}$. The track-on flags $FT^{(NN=1\ to\ 91)}$ are set to "0" when the power source is turned on. When at least one of the harmonic flag $FH^{(KN=13,NN)}$ to the harmonic flag $FH^{(KN=55,NN)}$ is "1", the CPU 12*a* sets the track-on flag $FT^{(NN)}$ to "1". On the other hand, when all of the flags among the harmonic flag $FH^{(KN=13,NN)}$ to the harmonic flag $FH^{(KN=55,NN)}$ are "0", the CPU 12*a* sets the track-on flag $FT^{(NN)}$ to "0".

Specifically, the CPU 12*a* operates as follows. That is, when the performer presses one of the keys of the keyboard device, the CPU 12*a* detects the note number KN assigned to the pressed key. Similarly to the first embodiment, the CPU 12*a* sets the note-on flag $FN^{(KN)}$ to "1". Furthermore, the CPU 12*a* sets the nine harmonic flags FH relating to the detected note number KN to "1".

Next, the CPU 12*a* updates the track-on flags $FT^{(NN)}$ relating to the note numbers NN as follows. That is, when at least one of the harmonic flag $FH^{(KN=13,NN=i)}$ to the harmonic flag $FH^{(KN=55,NN=i)}$ is "1", the CPU 12*a* sets the track-on flag $FT^{(NN=i)}$ to "1". When the track-on flag $FT^{(NN)}$ transitions from "0" to "1", the CPU 12*a* assigns three tone generation channels CH that are not operating to the track $TK^{(NN)}$. Accordingly, the CPU 12*a* dynamically assigns the tone generation channels $CH^{(n)}$ to the track $TK^{(NN)}$. Then, the CPU 12*a* supplies a command instructing reproduction of a musical sound signal using the waveform data $WD^{(NN)}$ in the three tone generation channels CH assigned to the track $TK^{(NN)}$ to the tone generator circuit 16.

On the other hand, when the performer releases the key that was pressed, the CPU 12*a* detects the note number KN assigned to the released key. Then, the CPU 12*a* sets the note-on flag $FN^{(KN)}$ to "0". Furthermore, the CPU 12*a* sets the nine harmonic flags $FH^{(KN,NN)}$ relating to the detected note number KN to "0".

Next, the CPU 12*a* updates the track-on flags $FT^{(NN)}$ relating to the note numbers NN as follows. That is, when all of the flags among the harmonic flag $FH^{(KN=13,NN=i)}$ to the harmonic flag $FH^{(KN=55,NN=i)}$ are "0", the CPU 12*a* sets the track-on flag $FT^{(NN=i)}$ to "0". When the track-on flag $FT^{(NN)}$ transitions from "1" to "0", the CPU 12*a* supplies a command instructing release (stopping operation and setting to a state of being assignable to a new track TK) of the three tone generation channels CH assigned to the track $TK^{(NN)}$ to the tone generator circuit 16.

Also, at a predetermined time interval (e.g., 10 milliseconds), the CPU 12*a* calculates the volume value $VL^{(NN)}$ relating to the note number NN and supplies it to the tone generator circuit 16. Note that it is sufficient that from among the track-on flags $FT^{(NN=1\ to\ 91)}$, the CPU 12*a* selects a track-on flag $FT^{(NN)}$ whose value is "1", calculates only the volume value $VL^{(NN)}$ relating to the note number that corresponds to the selected track-on flag $FT^{(NN)}$, and supplies it to the tone generator circuit 16. Similarly to the first embodiment, the volume value $VL^{(NN)}$ is calculated based on the following equation (2) using the note-on flag $FN^{(KN)}$ and the instruction values $DV_j$ of the drawbars $DB_j$.

$$\begin{aligned} VL^{(NN)} = {} & FN^{(KN=NN-36)} \cdot DV_9 + FN^{(KN=NN-31)} \cdot DV_8 + \\ & FN^{(KN=NN-28)} \cdot DV_7 + FN^{(KN=NN-24)} \cdot DV_6 + \\ & FN^{(KN=NN-19)} \cdot DV_5 + FN^{(KN=NN-12)} \cdot DV_4 + \\ & FN^{(KN=NN)} \cdot DV_3 + FN^{(KN=NN-7)} \cdot DV_2 + FN^{(KN=NN+12)} \cdot DV_1 \end{aligned}$$

Note that the note-on flags $FN^{(KN<13)}$ and the note-on flags $FN^{(KN>55)}$ are set to "0".

Also, similarly to the first embodiment, the CPU 12*a* sets the master reproduction speed factor θ according to the instruction value of the rotor speed selection switch RV.

Similarly to the first embodiment, the control unit CT of the tone generator circuit 16 updates the count value $t_p^{(NN)}$ and the count value $t_{ms}^{(CT)}$ each sampling period (e.g., every 1/44100 of a second). Also, the control unit CT starts the operation of the three tone generation channels $CH^{(n)}$ assigned to the track $TK^{(NN)}$ in accordance with the instruction from the CPU 12*a*. At this time, the count value $t_{ss}^{(NN)}$ of the slave sample counter $C_{ss}^{(NN)}$ is determined (initialized) according to the count value $t_{ms}^{(CT)}$ of the master sample counter $C_{ms}^{(CT)}$. For example, the control unit CT sets the pitch mark value immediately preceding the count value $t_{ms}^{(CT)}$ among the pitch mark values of the waveform data $WD^{(NN)}$ as the initial value of the count value $t_{ss}^{(NN)}$. Thereafter, the control unit CT updates the count value $t_{ss}^{(NN)}$ similarly to the first embodiment. Also, the control unit CT controls the tracks $TK^{(NN)}$ that are operating (reproducing musical sound signals), similarly to the first embodiment. That is, each time the count value $t_p^{(NN)}$ exceeds a pitch mark, the control unit CT causes the track $TK^{(NN)}$ to start generating a new grain $GR_i$. The procedure by which the track $TK^{(NN)}$ reproduces the musical sound signal is also similar to that of the first embodiment. For this reason, in the second embodiment as well, the value added to the count value $t_{ss}^{(NN)}$ is determined according to the setting value of the rotor speed selection switch RV, and thus the reproduction speed of the waveform data $WD^{(NN)}$ is set. Also, the control unit CT stops the operation of the track $TK^{(NN)}$ in accordance with an instruction from the CPU 12*a*. Furthermore, similarly to the first embodiment, the control unit CT controls the volume of the track $TK^{(NN)}$ based on the volume value $VL^{(NN)}$ received from the CPU 12*a*. According to the above description, the electronic musical instrument 10A can reproduce a musical sound signal specified based on the note number KN of the pressed key and the setting of the drawbars $DB_j$, at a reproduction speed and predetermined volume based on the setting value of the rotor speed selection switch RV, and thus the electronic musical instrument 10A can imitate a musical sound emitted from a rotor rotating at a predetermined rotation speed. Note that even if the phase of a musical sound signal reproduced by a track $TK^{(NN)}$ and the phase of another track TK are slightly misaligned when sound generation is started, the control unit CT sequentially corrects the count value $t_{ss}^{(NN)}$ using the count value $t_{ms}^{(CT)}$ as an index, similarly to the first embodiment. Accordingly, the phase of the musical sound signal reproduced by the track $TK^{(NN)}$ is sequentially corrected, and after a while, becomes approximately synchronous with the phase of the other track TK.

Others

In the second embodiment, the tone generation channels $CH^{(n)}$ are assigned to the tracks $TK^{(NN)}$ dynamically. For this reason, if the number of tone generation channels included in the tone generator circuit 16 is relatively small, there is a possibility that there will not be enough tone generation channels to be assigned to the track $TK^{(NN)}$. In this case, similarly to the conventional electronic musical instrument, the CPU 12*a* may select a track TK in accordance with a predetermined rule and mandatorily attenuate the musical sound being generated in the selected track TK. Then, the CPU 12*a* may cause a new musical sound to be generated in the selected track TK. Accordingly, even if the number of tone generation channels of the tone generator circuit 16 is smaller than in the first embodiment, it is possible to perform operations that are approximately similar to those of the first embodiment.

Figure 10:
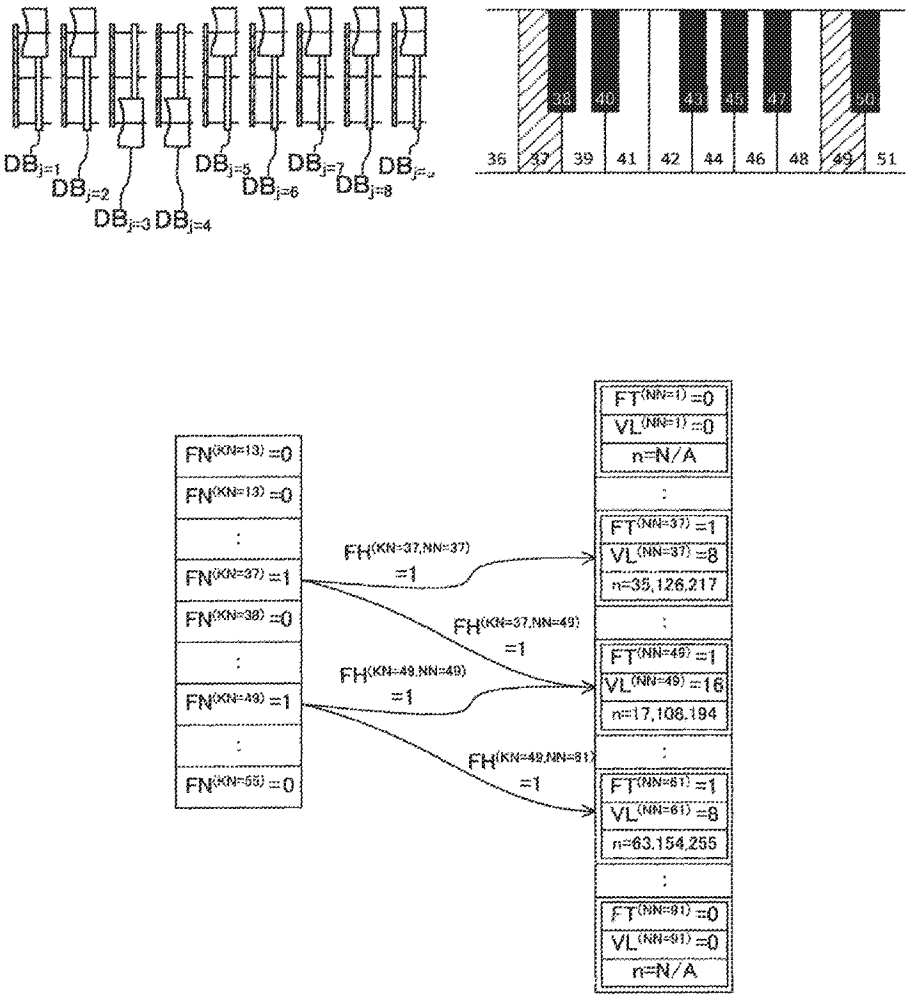
FIG. 10 is a table showing an example of setting values for various types of parameters.

Also, if a drawbar $DB_j$ is completely pushed in (that is, if the instruction value thereof is "0"), the track TK (tone generation channel $CH^{(n)}$) for generating the musical sound signal corresponding to that drawbar $DB_j$ can be omitted. In view of this, as illustrated in FIG. 10, the CPU 12*a* may set only the track-on flags $FT^{(NN)}$ relating to the note numbers NN whose volume values $VL^{(NN)}$ are greater than "0" to "1" and may assign the tone generation channels $CH^{(n)}$ to the track $TK^{(NN)}$ whose track-on flag $FT^{(NN)}$ has been set to "1". Note that in the example shown in FIG. 10, the setting values of the drawbar $DB_{j=3}$ and the drawbar $DB_{j=4}$ are at the maximum and the setting values of the other drawbars $DB_j$ are at "0". Then, in response to the two keys denoted by diagonal lines being pressed, the tone generation channels $CH^{(n)}$ are assigned to three tracks $TK^{(NN)}$ Thus, the tracks $TK^{(NN)}$ that are to run are limited depending on the setting of the drawbars $DB_j$. Accordingly, with this method, the number of tone generation channels to assign can be suppressed, and therefore operations that are approximately similar to those of the first embodiment can be performed even if the number of tone generation channels of the tone generator circuit 16 is even smaller.

Third Embodiment

Next, an electronic musical instrument 10B according to a third embodiment of the present invention will be described. The hardware configuration of the electronic musical instrument 10B is similar to those of the electronic musical instrument and the electronic musical instrument 10A. However, the electronic musical instrument 10B uses waveform data WD different from that of the electronic musical instrument 10 and the electronic musical instrument 10A. Specifically, in the above-described first embodiment and second embodiment, the waveform data WD is sampled such that only the signal of the electromagnetic pickup of one turn wheel is output. In contrast to this, in the third embodiment, the keys are pressed one by one in a state in which the drawbars of the electric organ are at a predetermined setting (e.g., in a state in which one or more preset switches have been pressed) and the musical sounds emitted from the rotary speaker are sampled. The third embodiment is similar to the above-described first embodiment and second embodiment with regard to the procedure in which the source data is cut out from the sampling data, the source data is subjected to time stretching (the length of the sound is changed), and the waveform data is generated. For this reason, in the third embodiment, waveform data $WD^{(NN=13\ to\ 5)}$ corresponding to the note numbers NN (=13 to 55) of the keys of the electronic musical instrument 10B is generated and stored in the waveform memory WM. Accordingly, with the electronic musical instrument 10B, one piece of waveform data WD includes the sounds (harmonics) of multiple tone wheels, and therefore the drawbars $DB_j$ do not function as operators for setting a combination of tone wheels (i.e., timber) and are used for another application.

Specifically, in the third embodiment, when the performer presses one of the keys of the keyboard device, the CPU 12*a* detects the note number NN assigned to the pressed key. Then, the CPU 21*a* sets the track-on flag $FT^{(NN)}$ corresponding to the detected note number NN to "1" and assigns three tone generation channels $CH^{(n)}$ that are not operating to the track $TK^{(NN)}$. Also, the CPU 12*a* supplies a command instructing reproduction of a musical sound signal using the waveform data $WD^{(NN)}$ in the track $TK^{(NN)}$ to the tone generator circuit 16.

On the other hand, when the performer releases the key that was pressed, the CPU 12*a* detects the note number NN assigned to the released key. Then, the CPU 12*a* sets the track-on flag $FT^{(NN)}$ corresponding to the detected note number NN to "0", and supplies a command instructing release (stopping the operation, and setting to a state of being assignable to a new track TK) of the three tone generation channels CH assigned to the track $TK^{(NN)}$ to the tone generator circuit 16.

Also, similarly to the first embodiment, the CPU 12*a* sets the master reproduction speed factor θ. Operations of the control unit CT of the tone generator circuit 16 are similar to those of the second embodiment.

In the above-described first embodiment and second embodiment, the pieces of waveform data WD each indicate a musical sound in a state in which only one tone wheel has been selected. For this reason, the tracks TK each reproduce a musical sound signal based on the waveform data WD corresponding thereto. Also, the volume values VL of the tracks TK are calculated according to the setting of the drawbars $DB_j$. In contrast to this, in the third embodiment, the pieces of waveform data WD each indicate a musical sound at a time when the drawbars of the electric organ are set to a predetermined state (i.e., when one key is pressed in a state in which the electromagnetic pickups of multiple tone wheels have been selected). For this reason, one track TK is assigned to one key, and a musical sound signal in a state in which the electromagnetic pickups of multiple tone wheels have been selected is obtained due to the tracks TK merely reproducing the corresponding waveform data WD. Thus, with the present embodiment, there is no need to calculate the volume values VL of the tracks TK, unlike with the first embodiment and the second embodiment. Accordingly, the load on the CPU 12*a* can be reduced compared to the above-described first embodiment and second embodiment. Also, even if the total number of tone generation channels CH is smaller compared to the first embodiment and the second embodiment, it is possible to operate similarly to the first embodiment and the second embodiment.

Note that in the third embodiment, waveform data WD indicating a musical sound at a time when the drawbars have been set to a predetermined state is used, and therefore the drawbars $DB_j$ are not used, unlike the above-described first embodiment and second embodiment. Instead, the third embodiment is configured such that one of multiple types of sets of waveform data WD can be selected by operating a button on a panel.

VARIATIONS

Furthermore, when carrying out the present invention, there is no limitation to the above-described embodiment, and various modifications can be made without straying from the object of the present invention.

For example, in the present embodiment, the waveform memory WM stores data, which is obtained by using an apparatus that is different from the electronic musical instrument 10 to change the reproduction speed of the source data, as the waveform data WD. However, the source data may be used as-is as the waveform data WD. In this case, when the instruction value of the rotor speed selection switch RV indicates "SLOW", the CPU 12*a* sets the master reproduction speed factor θ to "1". Also, when the instruction value of the rotor speed selection switch RV indicates "FAST", the CPU 12*a* sets the master reproduction speed factor θ to "8".

Also, for example, in the above-described embodiment, the rotation speed of the rotor is set to "SLOW" when obtaining the sampling data. However, the rotation speed of the rotor may be set to "FAST" when obtaining the sampling data. In this case, as described above, the data obtained by changing the reproduction speed of the source data extracted from the sampling data may be used as the waveform data WD, or the source data may be used as-is as the waveform data WD.

Also, for example, in the above-described embodiment, the musical sound of the electric organ emitted from the rotary speaker is subjected to monaural sampling. However, instead of this, the musical sound may be subjected to stereo sampling. That is, the sound emitted from the rotary speaker may be sampled using two microphones placed at an interval in the left-right direction in front of the rotary speaker, and waveform data for a left channel and waveform data for a right channel may be generated separately. In this case, the waveform data for the left channel and the waveform data for the right channel may be reproduced using separate tracks TK. At this time, in the first embodiment, 546 tone generation channels $CH^{(n)}$ are provided in the tone generator circuit 16. This makes it possible to obtain a richer chorus effect.

It is also possible to use a slave sample counter $C_{ss}^{(NN)}$ corresponding to one of tracks $TK^{(NN=1)}$, $TK^{(NN=2)}$, . . . as a master sample counter without using the master sample counter $C_{ms}^{(CT)}$. In order words, one of the tracks $TK^{(NN=1)}$, $TK^{(NN=2)}$, . . . may be used as a master track and the other tracks TK may be used as slave tracks.

Also, because the difference between the length (number of samples) of the reference waveform data and the length (number of samples) of the pieces of waveform data WD is actually small, the tone generator circuit 16 may adjust the reproduction speed of the track TK by considering the slave reproduction speed factor $\varphi^{(NN)}$ to be "1" and using only the correction factor $\Psi$.

Also, when waveform data expressing a key click sound of the electric organ is stored and a key is pressed, the waveform data of the key click sound may be read out and the key click sound may be added. In this case, for example, the waveform memory WM may store multiple pieces of waveform data that respectively indicate multiple key click sounds corresponding to the orientation of a rotor. Also, the tone generator circuit 16 may read out a piece of waveform data corresponding to the count value $t_{ms}^{(CT)}$ (that is, the rotor rotation angle) of the master sample counter $C_{ms}^{(CT)}$ from among the multiple pieces of waveform data and add the key click sound.

It is also possible to imitate a rotary speaker that includes a speaker for high-pitched sounds and a speaker for low-pitched sounds and includes rotors for each speaker. In this case, the musical sounds emitted from the rotors may be sampled by placing a microphone in the vicinity of each rotor, and waveform data for the high-pitched sound and waveform data for the low-pitched sound may be generated. Then, the waveform data for the high-pitched sound and the waveform data for the low-pitched sound may be generated using separate tracks TK. At this time, it is preferable to provide a master sample counter for the group of tracks TK that reproduce the waveform data for the high-pitched sounds, and a master sample counter for the group of tracks TK that reproduce the waveform data for the low-pitched sounds. That is, it is preferable to use two master sample counters. This makes it possible to individually manage master sample counters indicating the phases of the rotors using tracks TK that imitate the rotor for the high-pitched sounds and tracks TK that imitate the rotor for the low-pitched sounds, and therefore it is possible to imitate a state in which the orientation of the rotor for the high-pitched sounds and the orientation of the rotor for the low-pitched sounds are misaligned. Note that it is possible to sample only the musical sounds of the tone wheels in the high-pitched sound region using a microphone placed in the vicinity of the rotor for the high-pitched sounds, and to sample only the musical sounds of the tone wheels in the low-pitched sound region using a microphone placed in the vicinity of the rotor for the low-pitched sounds.

Also, for example, in the above-described embodiment, a pitch synchronous overlap and add method is used to change the reproduction speed of the waveform data WD, or in other words, to achieve a time stretching effect. However, the method for achieving the time stretching effect need not be limited to such an example, and may be selected as appropriate according to the embodiment. For example, an algorithm that performs overlap and add by cross-fading multiple segments cut out at a predetermined time interval that is not related to the pitch may be used to achieve the time stretching effect.

Also, in the above-described embodiment, three tone generation channels CH are assigned to one track TK, and musical sound signals generated by two of those tone generation channels CH are subjected to overlap and add. However, the number of tone generation channels CH that can be assigned to one track TK and the number of musical sound signals subjected to overlap and add need not be limited to such an example, and may be selected as appropriate according to the embodiment. For example, four or more tone generation channels CH may be assigned to one track TK, and a configuration may be used in which musical sound signals generated by three or more tone generation channels CH are subjected to overlap and add.

Also, in the above-described embodiment, a tone generator circuit 16 having multiple tone generation channels CH is used to achieve the time stretching effect. However, the time stretching effect may be achieved using the CPU 12*a*, a DSP (digital signal processor), and the like. In other words, the CPU 12*a*, the DSP, and the like may execute a program for reading out the waveform data WD in the RAM 12*c* and expanding/shortening the waveform data WD in the time axis direction. This program may be executed in real time or may be executed in non-real time.

Also, in the above-described embodiments 1 to 3, the storage unit of the present invention is constituted by the waveform memory WM, and the reproduction unit is constituted by the tone generator circuit 16. That is, the electronic musical instrument 10 (10A, 10B) according to the above-described embodiments 1 to 3 is constituted as an information processing apparatus in which a dedicated circuit such as the tone generator circuit 16 is used, the information processing apparatus being designed exclusively for generation of a musical sound that imitates the effect of a rotary speaker. Note that the hardware configuration of the musical sound signal generation apparatus need not be limited to such an example, and may be selected as appropriate according to the embodiment.

Figure 12:
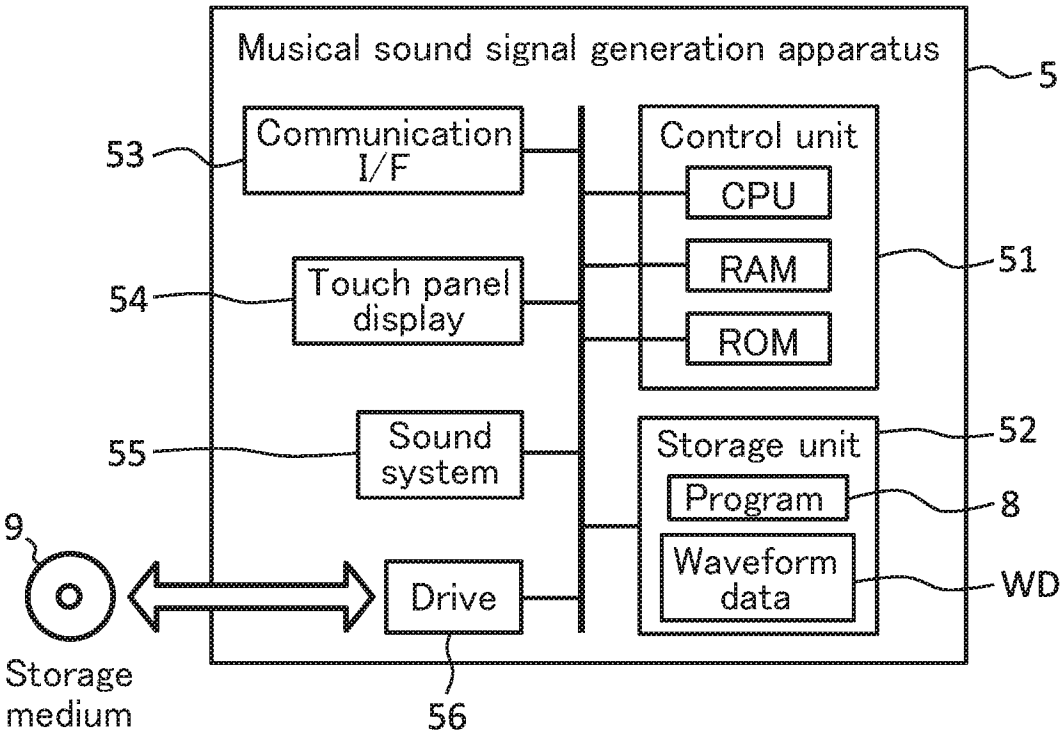
FIG. 12 schematically illustrates a hardware configuration of a musical sound signal generation apparatus according to another mode.

For example, as illustrated in FIG. 12, the musical sound signal generation apparatus may be constituted by a general-purpose information processing apparatus such as a personal computer. The musical sound signal generation apparatus 5 illustrated in FIG. 12 is a computer to which a control unit 51 including a CPU (Central Processing Unit), a RAM (Random Access Memory), a ROM (Read Only Memory), and the like, a storage unit 52 storing a program 8 to be executed by the control unit 51, waveform data WD, and the like, a communication interface 53 for performing communication via a network, a touch panel display 54 for performing image display and input, a sound system 55 for outputting a musical sound, and a drive 56 for loading a program stored in a storage medium 9 are electrically connected. The sound system 55 includes a D/A converter that converts a digital sound signal supplied from the control unit 51 into an analog sound signal, an audio amplifier that amplifies the converted analog sound signal and a speaker that outputs the amplified sound signal. Note that in FIG. 2, the communication interface is denoted as "communication I/F".

Note that the storage unit 52 may be an auxiliary storage device such as a hard disk drive or a solid state drive, for example. The type of the storage unit 52 can be selected as appropriate according to the embodiment. Also, the program 8 is a program that causes the musical sound signal generation apparatus 5 to execute processing for reproducing the above-described musical sound signal. The program 8 may be recorded in the storage medium 9. The storage medium 9 is a medium that stores information such as a recorded program by electric, magnetic, optical, mechanical, or chemical means such that the information such as the program can be read by a computer or other apparatus or machine, or the like. Note that as an example of the storage medium 9, FIG. 12 shows a disk-type storage medium such as a CD (Compact Disk) or a DVD (Digital Versatile Disk). However, the type of the storage medium 9 is not necessarily limited to being a disk type, and may be other than a disk type. Examples of storage media other than the disk type include a semiconductor memory such as a flash memory.

In the present variation, the control unit 51 expands the program 8 stored in the storage unit 52 to the RAM. Then, the control unit 51 interprets and executes the program 8 expanded to the RAM using the CPU so as to control the constituent elements. Accordingly, the musical sound signal generation apparatus 5 according to the present embodiment executes musical sound signal reproduction processing similarly to the electronic musical instrument 10 (10A, 10B) according to the above-described embodiments. For example, the control unit 51 can display images of a keyboard of the keyboard device, drawbars, the rotor speed selection switch, and the like illustrated in FIG. 2 on the touch panel display 54 and receive operations of the units from the performer. Also, the control unit 51 can expand the waveform data WD stored in the storage unit 52 to the RAM and execute calculation processing similar to that performed by the above-described tone generator circuit 16 and thereby change the reproduction speed of the musical sound signal corresponding to the waveform data WD to a reproduction speed designated using the rotor speed selection switch. Then, the control unit 51 can imitate the musical sound emitted from a rotor rotating at a predetermined rotation speed by outputting the musical sound signal with the thus-changed reproduction speed from the sound system 55.

The musical sound signal generation program 8 to execute processing for reproducing the above-described musical sound signal will be described with FIG. 13 and FIG. 14.

Figure 13:
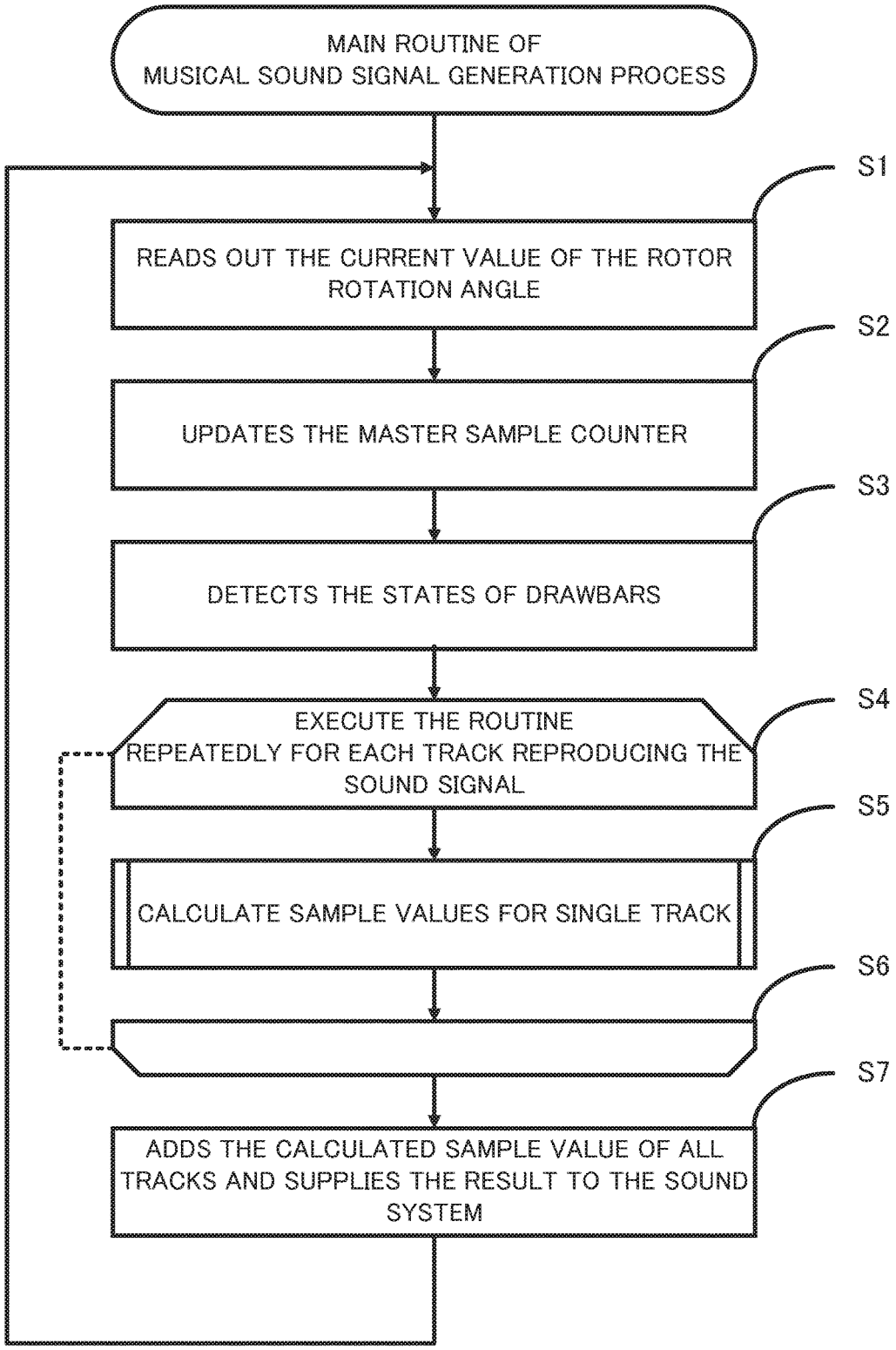
FIG. 13 is a flowchart illustrating a main routine of musical sound signal generation process.

FIG. 13 shows a flowchart illustrating a main routine of musical sound signal generation process executed in the CPU that interprets and executes the musical sound signal generation program 8. When the program 8 is started, the CPU executes processes of the step S1-S7 repeatedly. At step S1, the CPU reads out the current value of the rotor rotation angle that is a variable stored in the RAM. At step S2, the CPU updates the master sample counter with the rotation speed specified by the performer's operation. The master sample counter is a variable in the RAM and corresponds to the rotor rotation angle value. At step S3, the CPU detects the states of drawbars that are software objects displayed on the touch panel 54. And according to the states of drawbars, the CPU updates the states of track TK such as whether the track is reproducing a sound signal or not, the volume of the track, etc. The tracks are the software object stored in the RAM. The tracks TK correspond to the tone wheels. From step S4 to step S6, for each track reproducing the sound signal corresponding to a designated note number, the CPU execute the routine of step S5 repeatedly.

Figure 14:
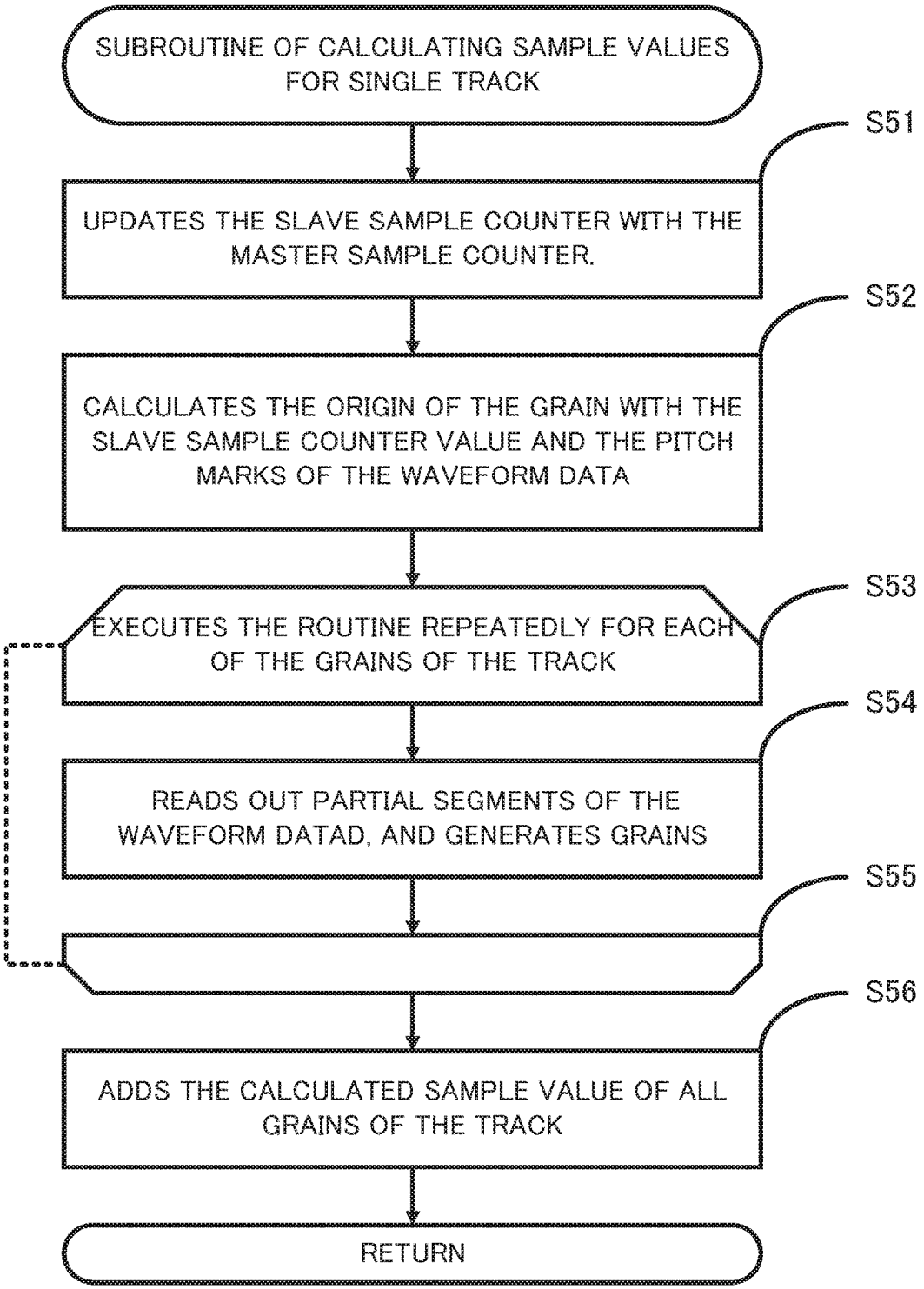
FIG. 14 is a flowchart illustrating a subroutine for executing the calculation of sample values for single track.

FIG. 14 shows a flowchart illustrating a subroutine for executing the calculation of sample values for single track at step S5. At step S51, the CPU updates the slave sample counter with the master sample counter. The slave sample counter is a variable in the RAM. In other words, the CPU determines the address of the waveform data WD corresponds to the rotation angle of the rotor. At step S52, the CPU calculates the origin of the grain with the slave sample counter value and the pitch marks of the waveform data WD. From step S53 to step S55, for each of the grains of the track, the CPU executes the processes of the step S54 repeatedly. At step S54, the CPU reads out partial segments of the waveform data WD, and generates grains by applying the window function. At step S56, the CPU adds the calculated sample value of all grains of the track GR. Then, the CPU returns to the main routine.

At step S7, the CPU adds the calculated sample value of all tracks TK or tone wheels and supplies the result to the sound system 55. Then, CPU returns to step S1.

Note that the musical sound signal generation apparatus in the present variation may process plural sample values at the each step and buffer the plural sample values over plural sampling periods until each of the sample values should be outputted, whereas the musical sound signal generation apparatus in embodiments 1 to 3 calculates and generates a sample value each sampling period.

The invention claimed is:

1. A musical sound signal generation apparatus for generating musical sound signals expressing musical sounds emitted from a rotary speaker having a rotor that rotates about a predetermined rotational axis so that a sound emission direction rotates as the rotor rotates, the musical sound signal generation apparatus comprising:

a storage unit storing at least one waveform data each constituted by a plurality of sample values, and expressing an acoustic waveform of a musical sound emitted from the rotary speaker while the rotor rotates about the predetermined rotational axis by a predetermined angle; and a reproduction unit configured to read out the sample values, constituting the waveform data from the storage unit, corresponding to count values of a master sample counter, the count values corresponding to a rotation angle of the rotor and being updated at a given speed, to generate musical sound signals based on the read-out sample values, wherein the reproduction unit is configured to generate each musical sound signal by:

reading out from the storage unit sample values of different segments of the waveform data, a position of each segment corresponding to the count values of the master sample counter; and overlapping and adding the read out sample values.

2. The musical sound signal generation apparatus according to claim 1, further comprising:

an operator for setting a rotating speed of the rotor, wherein the reproduction unit is configured to generate the musical sound signals corresponding to the count values of the master sample counter that corresponds to the rotation angle of the rotor and updated by the rotation speed of the rotor according to an operation state of the operator.

3. The musical sound signal generation apparatus according to claim 1, wherein the reproduction unit changes a reproduction speed of the musical sound using a pitch synchronous overlap and add technique.

4. The musical signal generation apparatus according to claim 1, wherein the reproduction unit is configured to repeatedly reproduce the waveform data between loop points that are set at a beginning and an end of each waveform data.

5. The musical signal generation apparatus according to claim 1, wherein each waveform data corresponds to a musical sound signal expressing a musical sound of a single tone wheel emitted from the rotary speaker.

6. The musical signal generation apparatus according to claim 5, wherein the reproduction unit is configured to generate a plurality of musical sound signals each corresponding to a single tone wheel, based on a pressed one key of a keyboard device.

7. The musical signal generation apparatus according to claim 1, wherein each waveform data corresponds to a musical sound signal expressing a musical sound including sounds of a plurality of tone wheels emitted from the rotary speaker.

8. The musical signal generation apparatus according to claim 1, wherein the reproduction unit reads out the sample values of each segment of one waveform data, and overlaps and adds the sample values corresponding to pressed one key of a keyboard device.

9. The musical sound signal generation apparatus according to claim 1, wherein the reproduction unit:

provides slave sample counters each corresponding to each of the sound signals;

updates count values of the slave sample counters to be approximately synchronous with the count values of the master sample counter; and reads out sample values from the storage unit of each segment, a position of each segment corresponding to the count values of the slave sample counters.

10. The musical sound signal generation apparatus according to claim 1, wherein the reproduction unit provides a plurality of tone generation channels each of which reads out the sample values from the storage unit of each segment.

11. The musical sound signal generation apparatus according to claim 2, wherein the count values of the master sample counter is updated by adding the count values of the master sample counter and a master reproduction speed factor θ according to the operation state of the operator.

12. The musical sound signal generation apparatus according to claim 11, wherein the master reproduction speed factor θ corresponds to a factor of speed at which a reference waveform data is reproduced, the reference waveform data corresponding to a reference time for the rotor to complete a single rotation when the operation state of the operator is set at a reference state.

13. The musical sound signal generation apparatus according to claim 12, wherein the reproduction unit:

provides slave sample counters each corresponding to each of the sound signals;

updates count values of the slave sample counters to be approximately synchronous with the count values of the master sample counter;

reads out sample values from the storage unit of each segment, a position of each segment corresponding to the count values of the slave sample counters; and updates each of the count values of the slave sample counters by adding each of the count values of the slave sample counters and a value obtained by multiplying the master reproduction speed factor θ and a slave reproduction speed factor φ to each of the count values of the slave sample counters.

14. The musical sound signal generation apparatus according to claim 13, wherein the slave reproduction speed factor φ corresponds to a ratio of a length of the waveform data with respect to a length of the reference waveform data.

15. The musical sound signal generation apparatus according to claim 10, wherein:

each of the tone generation channels generates grain as a signal of a portion of a musical sound signal, and one of the tone generation channels overlaps and adds each grain to generate one musical sound signal.

16. The musical sound signal generation apparatus according to claim 3, wherein the musical sound is extended and shortened in a time axis direction by the pitch synchronous overlap and add technique.

17. A musical sound signal generation method of generating musical sound signals expressing musical sounds emitted from a rotary speaker having a rotor that rotates about a predetermined rotational axis so that a sound emission direction rotates as the rotor rotates, the musical sound signal generation method comprising the steps of:

storing in a storage unit at least one waveform data each constituted by a plurality of sample values and expressing an acoustic waveform of a musical sound emitted from the rotary speaker while the rotor rotates about the predetermined rotational axis by a predetermined angle; and generating musical sound signals by reading out the sample values, constituting the waveform data from the storage unit, corresponding to count values of a master sample counter, the count values corresponding to a rotation angle of the rotor and being updated by a given speed, wherein the generating step generates each musical sound by:

reading out from the storage unit sample values of different segments of the waveform data, a position of each segment corresponding to the count values of the master sample counter; and overlapping and adding read out sample values.

* * * * *